US012103059B2

(12) United States Patent
Kitagoh et al.

(10) Patent No.: US 12,103,059 B2
(45) Date of Patent: Oct. 1, 2024

(54) CONTINUOUS ROLLING SYSTEM

(71) Applicant: Toshiba Mitsubishi-Electric Industrial Systems Corporation, Tokyo (JP)

(72) Inventors: Kazutoshi Kitagoh, Tokyo (JP); Mitsuhiko Sano, Tokyo (JP); Takahiro Onoda, Tokyo (JP)

(73) Assignee: TMEIC CORPORATION, Tokyo (JP)

( * ) Notice: Subject to any disclaimer, the term of this patent is extended or adjusted under 35 U.S.C. 154(b) by 197 days.

(21) Appl. No.: 17/757,362

(22) PCT Filed: Nov. 16, 2020

(86) PCT No.: PCT/JP2020/042655

§ 371 (c)(1),
(2) Date: Jun. 15, 2022

(87) PCT Pub. No.: WO2022/102138

PCT Pub. Date: May 19, 2022

(65) Prior Publication Data

US 2023/0011915 A1 Jan. 12, 2023

(51) Int. Cl.

| | |
|---|---|
| ***B21B 37/20*** | (2006.01) |
| ***B21B 37/26*** | (2006.01) |
| ***B21B 37/58*** | (2006.01) |

(52) U.S. Cl.

CPC ..... *B21B 37/20* (2013.01); *B21B 37/26* (2013.01); *B21B 37/58* (2013.01); *B21B 2271/02* (2013.01)

(58) Field of Classification Search

CPC ..... B21B 37/20; B21B 37/26; B21B 37/58; B21B 2271/02; B21B 38/04; B21B 38/08; B21B 38/10; B21B 38/105

See application file for complete search history.

(56) References Cited

U.S. PATENT DOCUMENTS

2015/0174629 A1* 6/2015 Carvalho ..... B21B 37/74 72/14.6
2016/0023257 A1* 1/2016 Brown ..... B21B 35/00 72/12.3

(Continued)

FOREIGN PATENT DOCUMENTS

JP 2009-113109 A 5/2009
JP 2018-134673 A 8/2018

OTHER PUBLICATIONS

International Search Report with English Translation and Written Opinion mailed on Jan. 19, 2021, received for PCT Application PCT/JP2020/042655, Filed on Nov. 16, 2020, 10 pages.

*Primary Examiner* — Mohammed S. Alawadi
(74) *Attorney, Agent, or Firm* — XSENSUS LLP

(57) ABSTRACT

When the tracking point reaches the i-th stand, the continuous rolling system outputs, to an i-th stand, a roll gap operation value for bringing to zero a difference between a value which is obtained by correcting a strip thickness target value of the i-th stand with a target strip thickness correction value of the i-th stand and a value which is obtained by correcting a strip thickness actual recalculation value of the i-th stand with a gap correction value of the i-th stand. Here, the gap correction value is a correction value that brings to zero a difference between a head end gap error when a head end of the material to be rolled reaches the i-th stand and a non-head end gap error when a part other than the head end of the material to be rolled reaches the i-th stand.

15 Claims, 14 Drawing Sheets

(56) References Cited

U.S. PATENT DOCUMENTS

| | | | | |
|---|---|---|---|---|
| 2019/0047029 | A1* | 2/2019 | Grüss | G05B 19/056 |
| 2021/0060630 | A1* | 3/2021 | Imanari | B21B 13/14 |

* cited by examiner

CONTINUOUS ROLLING SYSTEM

CROSS-REFERENCE TO RELATED APPLICATION

The present application is based on PCT filing PCT/JP2020/042655, filed Nov. 16, 2020, the entire contents of which are incorporated herein by reference.

FIELD

The present disclosure relates to roll force distribution control of a continuous rolling system.

BACKGROUND

FIG. 2 is a diagram that shows a part of a hot rolling line where metal is processed. The rolling line 20 shown in FIG. 2 includes a tandem rolling mill 2. The tandem rolling mill 2 is a continuous rolling mill of a tandem style which is called a strip mill, in which several rolling stands are adjacently arranged in series and continuously rolls one strip of a material to be rolled 2*b* in one direction.

The tandem rolling mill 2 has N (N is a natural number of 3 or greater) rolling stands 2*a*. The N rolling stands 2*a* are called a first stand $F_1$, a second stand $F_2$, a third stand $F_3$, . . . , an i-th stand $F_i$, . . . , and an N-th stand $F_N$ sequentially from an upstream side (entry side) of the tandem rolling mill 2. In the description below, the "rolling stand" will also be simply described as "stand."

A strip thickness gauge 2*c* is placed on a delivery side of a final stand (the N-th stand) and measures the strip thickness of the material to be rolled 2*b*. The strip thickness gauge may be arranged between the stands.

FIG. 3(A) is a diagram when a rolling stand 2*a* is viewed from a roll axis direction. FIG. 3(B) is a diagram when the rolling stand 2*a* is viewed from a traveling direction of the material to be rolled 2*b*. The rolling stand 2*a* includes a pair of upper/lower work rolls 3*a*. By changing a roll gap between the upper/lower work rolls 3*a*, a delivery side strip thickness of the rolling stand 2*a* can be controlled. In the description below, the "delivery side strip thickness" will also be simply described as "strip thickness."

The strip speed at a stand delivery side is changed by changing the rotational speed of the upper/lower work rolls 3*a*. A pair of upper/lower backup rolls 3*b* supports the upper/lower work rolls 3*a* from above and below. Each of hydraulic cylinders 3*c* is mounted at a chock part of the backup rolls 3*b*. The hydraulic cylinders 3*c* adjust a roll gap by moving upward and downward. In the description below, the "roll gap" will also be simply described as "gap."

Each of load cells 3*d* is placed on a strut that supports a chock part of the lower-side backup roll 3*b*. The load cells 3*d* detect roll force (rolling force). The roll force can be roughly estimated from a pressure gauge that measures the pressure of each of the hydraulic cylinders 3*c*. Note that the load cells 3*d* may be placed at the positions of the cylinders of the upper-side backup roll 3*b*.

Encoders 3*e* are mounted at chock ends of the work rolls 3*a* and detect the roll rotational speed of the work rolls 3*a*. A roll circumferential speed is calculated based on the roll rotational speed.

CITATION LIST

Patent Literature

[PTL 1] JP 2018-134673 A
[PTL 2] JP 2009-113109 A

SUMMARY

Technical Problem

The roll force (rolling force) is known as changing at least by the temperature of a material to be rolled, the entry side strip thickness of a stand, the delivery side strip thickness of the stand, and a rolling speed, and also by tension between the stands, the diameter of a roll, a friction state between the roll and the material to be rolled, a chemical component of the material to be rolled, the state of crystal grains of the material to be rolled, the history of rolling in the past, and the like (equation (1)). On an actual rolling line, change in the roll force is complicated and a correct roll force cannot be grasped only by calculation. In order to grasp the roll force, a roll force actual value is measured by using sensors such as the load cells 3*d*.

[Math. 1]

$$P_i=P(T,H,h,V,\ldots) \tag{1}$$

where
P: roll force
T: temperature
H: strip thickness on entry side (entry side strip thickness)
h: strip thickness on delivery side (delivery side strip thickness)
V: rolling speed According to the findings of the inventor, a stable rolling can be achieved by performing control so that an actual roll force ratio between all the stands of the tandem rolling mill 2 matches with a target roll force ratio.

However, in a situation where rolling is continued without stopping, roll force distribution changes mainly for the following factors:

(Factor 1) Temperature change of a material to be rolled on a stand entry side (Factor 2) Change in a roll diameter due to: thermal expansion of a roll which is caused by heat input to the roll; and abrasion of the roll which is caused by contact between the roll and a material to be rolled (Factor 1 that Causes a Change in Roll Force Distribution: Temperature Change of a Material to be Rolled on a Stand Entry Side)

When the temperature of a material to be rolled on a stand entry side changes, roll force required for deformation of the material to be rolled changes. A calculation value of a stand delivery side strip thickness is calculated by using equation (2) based on a roll gap and roll force.

[Math. 2]

$$h_i=S_i+P_i/M_i \tag{2}$$

where
$h_i$: delivery side strip thickness of the i-th stand [mm]
$S_i$: roll gap of the i-th stand [mm]
$P_i$: roll force of the i-th stand [kN]
$M_i$: mill stiffness coefficient of the i-th stand [kN/mm]

Therefore, in order to keep the delivery side strip thickness $h_i$ constant, it is necessary to reduce (close) the roll gap by an amount corresponding to an amount by which the roll force has increased, as shown in equation (4).

[Math. 3]

$$h_i=S_i+P_i/M_i \quad (3)$$

[Math. 4]

$$h_i=S_i+\Delta S+(P_i+\Delta P)/M_i \quad (4)$$

[Math. 5]

$$\Delta S=-\Delta P/M \quad (5)$$

where

ΔP: roll force change amount [kN]

ΔS: gap change amount [mm]

As a result, when the temperature of the material to be rolled decreases, the roll force increases and by reducing the roll gap, the strip thickness can be kept constant but the roll force further increases.

FIG. 4 is a graph that shows changes in the roll force actual value and gap actual value due to a temperature change on a rolling line entry side. The graph of FIG. 4 indicates changes of the roll force actual value 4*b* and gap actual value 4*c* of the most upstream stand when a mill entry side temperature 4*a* decreases. When the mill entry side temperature 4*a* decreases, the material to be rolled hardens with a decrease in temperature and accordingly, the roll force actual value 4*b* increases. When the roll force actual value 4*b* increases, the delivery side strip thickness 4*d* increases as shown in equation (2) as long as the gap actual value 4*c* does not change. Therefore, in order to keep the delivery side strip thickness 4*d* constant, control to reduce the roll gap is performed.

As a result, the gap actual value 4*c* decreases and the delivery side strip thickness 4*d* is kept constant; however, the roll force actual value 4*b* further increases.

FIG. 5 is graphs that show a change in the roll force of each stand due to a temperature change on the rolling line entry side. FIG. 5(A) shows a roll force actual value 5*a* of each stand at the start time of rolling and a roll force distribution ratio target value 5*b*. At the start time of rolling, a roll force distribution ratio actual value 5*c* which is calculated from the roll force actual value 5*a* of each stand matches the roll force distribution ratio target value 5*b*.

When the temperature uniformly decreases up to a final stand (the N-th stand $F_N$) during rolling, the roll force distribution ratio does not change significantly. However, in general, when temperature on an upstream side changes, a spray between stands is adjusted or a rolling speed is changed, so that the delivery side temperature of the final stand is kept constant.

Therefore, as in FIG. 5(B), while the roll forces of upstream side stands significantly change, the roll forces of downstream side stands do not change so much; therefore, the roll force distribution ratio actual values 5*c* deviate from the roll force distribution ratio target values 5*b*.

(Factor 2 that Causes a Change in Roll Force Distribution: The Amount of Thermal Expansion and Amount of Abrasion of a Roll)

Next, a change in the roll force distribution according to the amount of thermal expansion and amount of abrasion of work rolls will be described. The amount of thermal expansion is an amount by which a roll diameter has increased due to thermal expansion of rolls as a result of an increase in a roll temperature which has been caused by thermal conduction between the rolls and a material to be rolled during rolling. The amount of abrasion is an amount by which the roll diameter has decreased due to abrasion of the roll due to contact with the material to be rolled. The amount of thermal expansion can be controlled to some extent by a cooling facility; however, the amount of abrasion is increasing as long as rolling continues.

FIG. 6 is a diagram that shows a change in the roll diameter for which the amount of thermal expansion and the amount of abrasion are taken into consideration. The diameter of each work roll 3*a* is 500 mm or more, while a change by the amount of thermal expansion and the amount of abrasion is about several hundred μm. Therefore, a change in the roll diameter cannot be found by a visual check. However, since strip control requires the accuracy of several μm, a change in the roll diameter due to the amount of thermal expansion and the amount of abrasion cannot be ignored.

The 6*a* that is shown in FIG. 6(A) indicates a change in the roll diameter in a width direction by the amount of thermal expansion. The 6*b* that is shown in FIG. 6(B) indicates a change in the roll diameter in a width direction by the amount of abrasion. As a result of combining these two changes, the roll diameter distribution complicatedly changes like 6*c* that is shown in FIG. 6(C).

The gap actual value that is calculated from the amount of operating the hydraulic cylinders 3*c* does not include the above-described change in the roll diameter by the amount of abrasion and the amount of thermal expansion. Therefore, a deviation occurs between the gap actual value and a gap true value that is a real roll gap. As strip thickness changes by an error $\Delta Stw_i$ between the gap true value and the gap actual value, the roll force $P_i(\Delta h_i+h_i)$ also changes. Therefore, as shown in equation (6), the error $\Delta Stw_i$ between the gap true value and the gap actual value does not simply represent a strip thickness change amount $\Delta h_i$.

[Math. 6]

$$\Delta h_i+h_i=\Delta Stw_i+S_i+P_i(\Delta h_i+h_i)/M_i \quad (6)$$

FIG. 7 is a graph that shows changes in the gap actual value and roll force actual value when the amount of abrasion increases. In an example shown in FIG. 7, it is assumed that the amount of abrasion is more than the amount of thermal expansion. Usually, on a stand that does not have a strip thickness gauge on its delivery side, a roll gap is controlled so that a strip thickness actual recalculation value 7*a* matches a strip target value on the stand delivery side. The strip thickness actual recalculation value 7*a* is calculated as follows.

[Math. 7]

$$hg_i=S_i^{act}+P_i^{act}/M_i \quad (7)$$

where $hg_i$: a strip thickness actual recalculation value [mm]

$S_i^{act}$: a gap actual value [mm]

$P_i^{act}$: a roll force actual value [kN]

At this time, when the amount of abrasion and the amount of thermal expansion change and an error between a gap true value and a gap actual value increases, the strip thickness actual value 7*b* increases as shown in equation (8).

[Math. 8]

$$h_i+\Delta h_i=hg_i+hof_i+\Delta Stw_i=S_i^{act}+P_i^{act}/M_i+hof_i+\Delta Stw_i \quad (8)$$

where $hg_i$: a strip thickness actual recalculation value [mm]

$\Delta Stw_i$: an error between the gap true value and the gap actual value [mm]

$hof_i$: a difference between the strip thickness actual value and the strip thickness actual recalculation value, excluding $\Delta Stw_i$ [mm]

When the strip thickness actual value 7*b* increases, the amount of roll down decreases and therefore, the roll force actual value 4*b* decreases; however, the strip thickness actual recalculation value 7*a* is controlled to be constant and therefore, the gap actual value 4*c* increases. As a result, the roll force actual value 4*b* further decreases. Here, the gap error $\Delta Stw_i$ by the amount of thermal expansion and the amount of abrasion cannot be directly measured. By adding predictions of the amount of abrasion and the amount of thermal expansion to the above equation (7), a difference between the strip thickness actual value and the strip thickness actual recalculation value can be reduced. However, the amount of abrasion and the amount of thermal expansion change according to a roll material, water being used, oil, a surface condition of a steel kind to be rolled, and the like; and therefore, it is difficult to obtain a complete match only by prediction.

Especially, in recent years, not only manufacture of one coil from one slab but also manufacture of a plurality of coils from one long slab has become possible. In such rolling, the rolling continues for several hours and therefore, the amount of abrasion of rolls increases. As a result, a roll force variation caused from an error of the prediction of the amount of roll abrasion, which is described above, is more likely to occur.

As described above, the roll force is unavoidably influenced by a temperature change, an increase in the amount of abrasion, and the like, and complicatedly changes so as to satisfy a target strip thickness. Regarding roll force distribution control, two patent literatures have been provided.

According to Patent Literature 1 (JP 2018-134673 A), a gap of adjacent stand is modified so that a predetermined roll force distribution is maintained even during rolling. Especially, roll force of a latter-stage stand is modified so as to modify a roll force distribution that has been changed by compensating a difference, which occurs after strip passing, between a strip thickness measurement value and a strip thickness target value. However, even by modifying a roll force distribution between specific two stands, a roll force distribution between all stands cannot be modified.

According to Patent Literature 2 (JP 2009-113109 A), when a roll force distribution for each stand on which rolling is being performed is modified by operator's manual intervention, roll force distribution control is executed by using a roll force distribution after the manual intervention as a target value.

However, the above two patent literatures do not include means for compensating a gap error between a strip thickness actual value and a strip thickness actual recalculation value. In a case of continuous rolling, a roll force distribution may change due to the gap error. In roll force distribution control that uses only a roll force actual value without compensating the gap error, a strip shape on a stand delivery side changes due to a change in the delivery side strip thickness of each stand, in which there is a possibility of causing a shape failure and a possibility of causing saturation of output of the roll force distribution control.

In addition, the roll force distribution control in the above two patent literatures is asynchronous control. For example, when a roll gap is changed on an upstream side stand, a stand delivery-side strip thickness of a portion of the change on a material to be rolled changes. However, in the asynchronous control, the position of the change portion is not tracked. Therefore, when the change portion reaches a downstream side stand, its roll force varies under the influence of a strip thickness change amount. Synchronous control is desirable in which a roll gap is controlled when the change portion reaches each stand.

The present disclosure has been made in order to solve the above-mentioned problems and it is an object of the present disclosure to provide a continuous rolling system that can achieve a stable rolling by performing control so as to match an actual roll force ratio between all stands with a target roll force ratio during continuous rolling.

Solution to Problem

In order to achieve the above object, a continuous rolling system according to the present disclosure is configured as follows.

The continuous rolling system according to the present disclosure changes product specifications during continuous rolling of one strip of a material to be rolled. The continuous rolling system includes a tandem rolling mill, a strip thickness gauge, and a roll force distribution control device. The tandem rolling mill has a plurality of rolling stands. The tandem rolling mill continuously rolls the material to be rolled in one direction from an upstream side of the plurality of rolling stands to a downstream side. Each of the plurality of rolling stands controls a roll gap according to a roll gap operation value. The strip thickness gauge is provided on a delivery side of the tandem rolling mill and measures a strip thickness of the material to be rolled.

In a first aspect, the roll force distribution control device includes, in order to match an actual roll force ratio between the plurality of rolling stands with a target roll force ratio, a setting calculation unit, an actual data collection unit, a mass flow thickness correction unit, a target strip thickness correction value calculation unit, a tracking unit and a gap operation unit.

The setting calculation unit determines: a strip thickness target value of each of the plurality of rolling stands; and a roll force distribution ratio target value of each of the plurality of rolling stands, the roll force distribution ratio target value representing the target roll force ratio between the plurality of rolling stands.

The actual data collection unit collects: a roll force actual value of each of the plurality of rolling stands; a roll gap actual value of each of the plurality of stands, the roll gap actual value being calculated based on the roll gap operation value of each of the plurality of rolling stands; a roll rotational speed actual value of each of the plurality of rolling stands; and a strip thickness measurement value that is measured with the strip thickness gauge. The roll gap actual value does not include a change in a roll diameter due to the amount of abrasion and amount of thermal expansion of a roll.

The mass flow thickness correction unit calculates a strip thickness actual value of each of the plurality of rolling stands based on the strip thickness measurement value and the roll rotational speed actual value of each of the plurality of rolling stands. The mass flow thickness correction unit calculates a strip thickness actual recalculation value of each of the plurality of rolling stands based on the roll force actual value of each of the plurality of rolling stands and the roll gap actual value of each of the plurality of rolling stands. The mass flow thickness correction unit calculates a gap error of each of the plurality of rolling stands based on a difference between the strip thickness actual value of each of the plurality of rolling stands and the strip thickness actual recalculation value of each of the plurality of rolling stands. The mass flow thickness correction unit calculates a gap correction value for each of the plurality of rolling stands, the gap correction value being for preventing the gap error of each of the plurality of rolling stands from changing.

The gap correction value is a correction value that brings to zero a difference between a correction reference gap error that is the gap error when a head end of the material to be rolled reaches the i-th stand ($1 \leq i \leq N$) and a non-head-end gap error that is the gap error when a part other than the head end of the material to be rolled reaches the i-th stand.

The target strip thickness correction value calculation unit calculates a roll force distribution ratio actual value of each of the plurality of rolling stands, the roll force distribution ratio actual value representing the actual roll force ratio between the plurality of rolling stands, based on the roll force actual value of each of the plurality of rolling stands. The target strip thickness correction value calculation unit calculates a target strip thickness correction value of each of the plurality of rolling stands based on a difference between the roll force distribution target value of each of the plurality of rolling stands and the roll force distribution ratio actual value of each of the plurality of rolling stands.

The tracking unit tracks a tracking point that is set on the material to be rolled.

The gap operation unit outputs, when the tracking point reaches each of the plurality of rolling stands, the roll gap operation value to a target rolling stand that is the each rolling stand reached by the tracking point. The roll gap operation value brings, to zero, a difference between a value that is obtained by correcting the strip thickness target value of the target rolling stand with the target strip thickness correction value of the target rolling stand and a value that is obtained by correcting the strip thickness actual recalculation value of the target rolling stand with the gap correction value of the target rolling stand.

In a second aspect, the continuous rolling system includes a gap operation end intervention unit that allows the roll gap operation value to be changed based on an intervention signal by an operator.

The roll force distribution control device calculates the roll force distribution ratio actual value of each of the plurality of rolling stands based on the roll force actual value of each of the plurality of rolling stands, the roll force actual value being collected after the roll gap operation value which has been changed is applied to the tandem rolling mill. The roll force distribution control device updates the roll force distribution ratio target value of each of the plurality of rolling stands with the roll force distribution ratio actual value of each of the plurality of rolling stands.

In a third aspect, the roll force distribution control device interrupts calculation of the gap correction value and the target strip thickness correction value before executing flying strip thickness change in which the strip thickness target value of the tandem rolling mill is changed without stopping rolling by the tandem rolling mill. The roll force distribution control device stores the correction reference gap error before the execution of the flying strip thickness change. The roll force distribution control device resets the roll force distribution ratio target value for the flying strip thickness change. The roll force distribution control device calculates the correction reference gap error after the execution of the flying strip thickness change by adding a difference between the gap error after the execution of the flying strip thickness change and the gap error before the execution of the flying strip thickness change to the correction reference gap error before the execution of the flying strip thickness change. The roll force distribution control device resumes, after calculating the correction reference gap error after the execution of the flying strip thickness change, the calculation of the gap correction value and the target strip thickness correction value.

In a fourth aspect, the roll force distribution control device stores a table that defines a relationship between the type and size of the material to be rolled and a control gain. The roll force distribution control device obtains the control gain corresponding to the type and size of the material to be rolled from the table. The gap correction value is calculated by multiplication by the control gain. The target strip thickness correction value is calculated by multiplication by the control gain.

In a fifth aspect, each of the rolling stands includes an actuator that controls the shape of the material to be rolled.

The roll force distribution control device changes the roll force distribution ratio target value of the rolling stand having the actuator in a direction of reducing an output of the actuator when the output reaches an upper limit value and in a direction of increasing an output of the actuator when the output reaches a lower limit value.

In a sixth aspect, the roll force distribution control device reduces the gap error which occurs during the change of strip thickness by the flying strip thickness change, gradually with time.

Advantageous Effects of Invention

According to the continuous rolling system of the present disclosure, a gap correction value and a target strip thickness correction value are applied sequentially from an upstream side stand and thereby, control can be performed so as to match an actual roll force ratio between all the stands with a target roll force ratio during continuous rolling. Therefore, the roll force distribution during continuous rolling is kept constant, allowing a stable rolling to be achieved.

Allowing the roll force distribution ratio to be kept constant prevents roll force from being concentrated on a specific stand, so that the roll force or motor torque can be prevented from exceeding a limit value.

In addition, allowing the roll force distribution ratio to be kept constant prevents roll force from being concentrated on a specific stand, so that a defective shape (defective flatness) of a material to be rolled can be prevented.

Furthermore, allowing the roll force distribution ratio to be kept constant prevents an unbalanced increase in the amount of abrasion of a specific stand.

DESCRIPTION OF EMBODIMENTS

Figure 1:
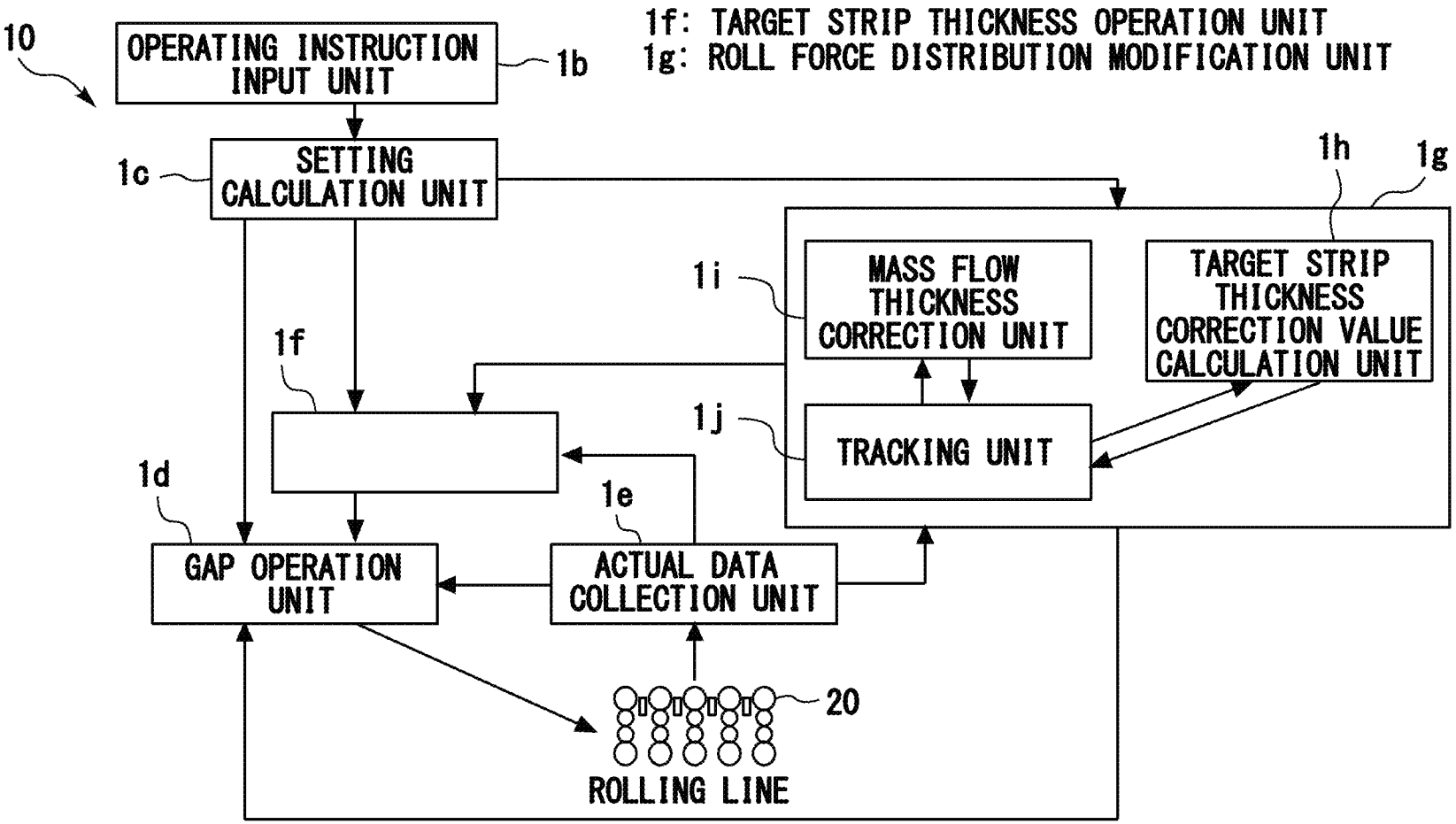
FIG. 1 is a diagram for describing a system configuration of a continuous rolling system according to a first embodiment.

Hereinafter, embodiments of the present disclosure will be described in detail with reference to drawings. However, when numbers such as the number, quantity, volume, or range of elements are referred to in the embodiments presented below, the present disclosure is not limited by the numbers referred to except where especially explicitly specified and where clearly specified to the numbers in principle. In addition, structures and the like that are described in the embodiments presented below are not necessarily required for this disclosure except where especially explicitly specified and where clearly specified thereto in principle. Note that common elements in the drawings are denoted by the same reference signs to omit redundant explanations.

As described above, herein, the "rolling stand" is also simply described as "stand." The "roll gap" is also simply described as "gap." The "delivery side strip thickness" is also simply described as "strip thickness." Therefore, the "strip thickness target value," "strip thickness actual value," and "strip thickness actual recalculation value" relate to a strip thickness on a stand delivery side.

First Embodiment (System Configuration)

Figure 2:
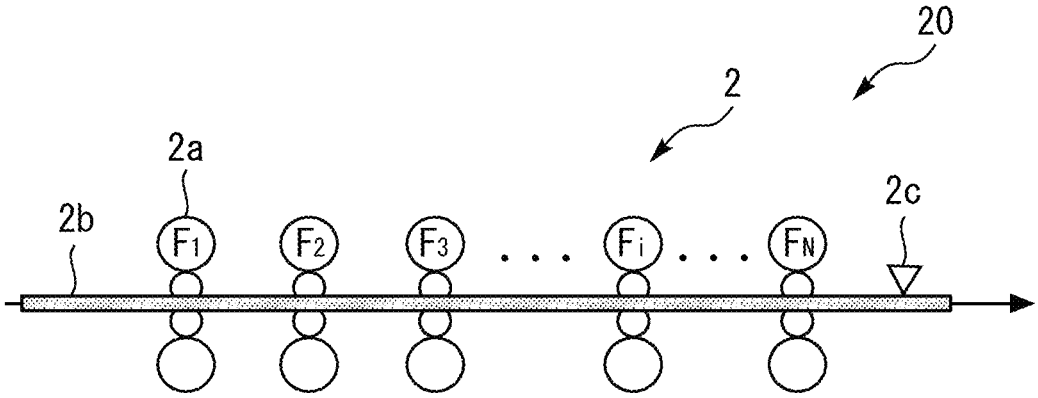
FIG. 2 is a diagram that shows a part of a hot rolling line where metal is processed.
Figure 3:
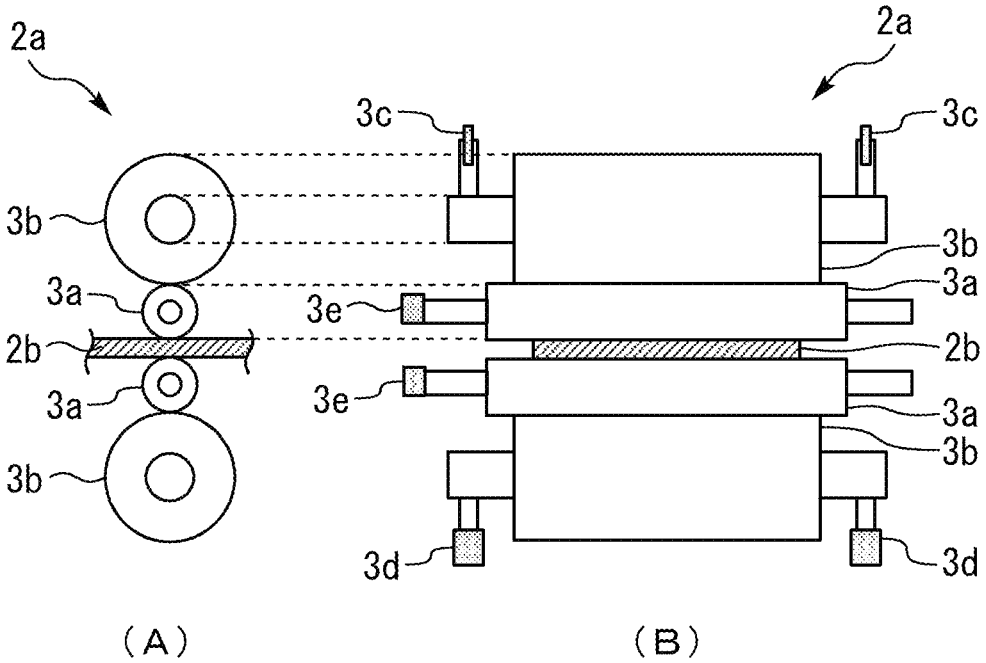
FIG. 3 is a diagram for describing a configuration of a rolling stand.
Figure 4:
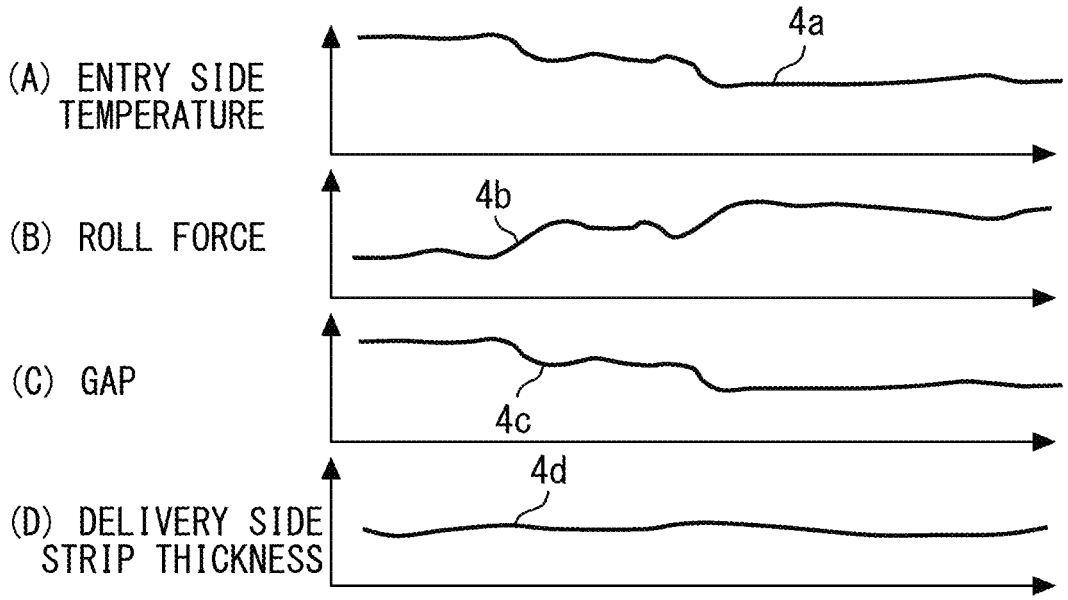
FIG. 4 is a graph that shows changes in a roll force actual value and gap actual value due to a temperature change on a rolling line entry side.
Figure 5:
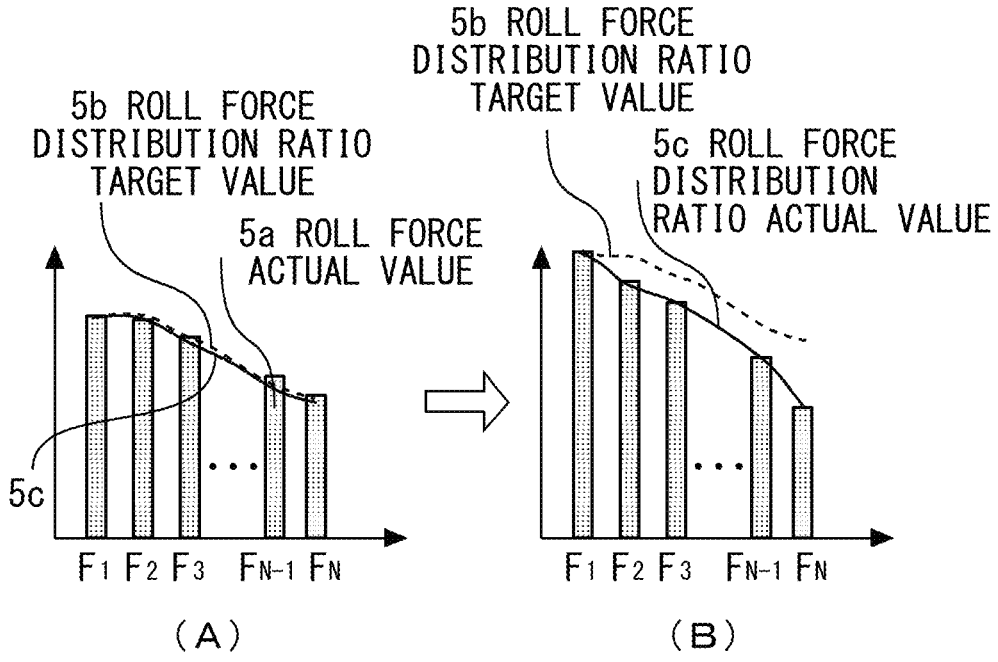
FIG. 5 is graphs that show a change in roll force of each stand due to temperature change on the rolling line entry side.
Figure 6:
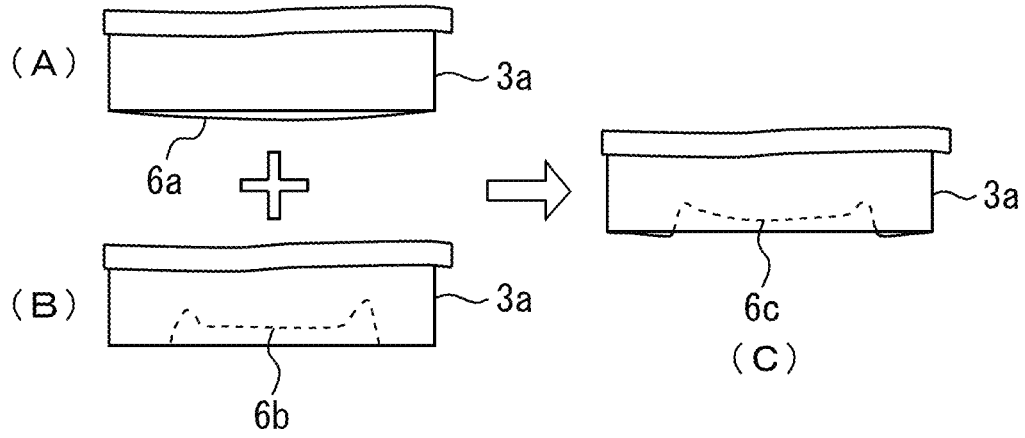
FIG. 6 is a diagram that shows a change in a roll diameter for which the amount of thermal expansion and the amount of abrasion are taken into consideration.
Figure 7:
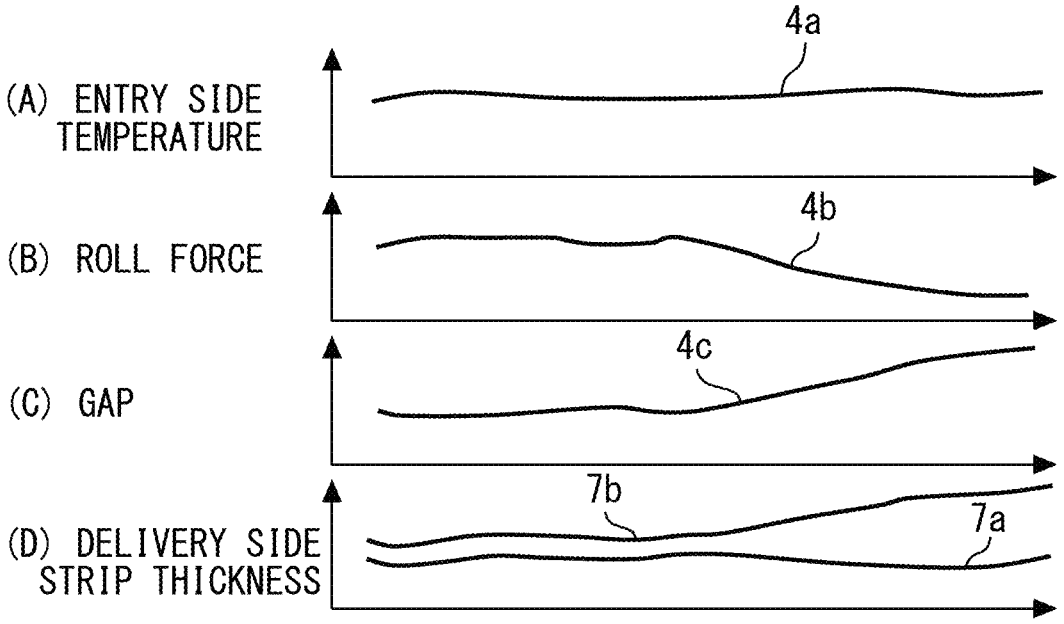
FIG. 7 is a graph that shows changes in the gap actual value and roll force actual value when the amount of abrasion increases.

A first embodiment of the present disclosure will be described. FIG. 1 is a diagram for describing a system configuration of a continuous rolling system according to the first embodiment of the present disclosure. The continuous rolling system that changes product specifications during continuous rolling of one material to be rolled includes a roll force distribution control device 10 and a rolling line 20. The rolling line 20 is a hot rolling line. As shown in FIG. 2, the rolling line 20 includes a tandem rolling mill 2 having a plurality of rolling stands. Each of the plurality of rolling stands controls a roll gap according to a roll gap operation value. A concrete configuration example of the rolling line 20 is the same as in FIG. 2 and FIG. 3 described above and therefore, the explanation thereof will be omitted.

The roll force distribution control device 10 includes, in order to match an actual roll force ratio between the plurality of rolling stands with a target roll force ratio, an operating instruction input unit 1*b*, a setting calculation unit 1*c*, a gap operation unit 1*d*, an actual data collection unit 1*e*, a target strip thickness operation unit 1*f*, a roll force distribution modification unit 1*g*, a target strip thickness correction value calculation unit 1*h*, a mass flow thickness correction unit 1*i*, and a tracking unit 1*j*.

The operating instruction input unit 1*b* outputs, to the setting calculation unit 1*c*, an operating instruction that includes base material information of a material to be rolled 2*b* (entry side strip thickness, entry side strip width, type, etc.) and target information of the material to be rolled 2*b* (strip thickness, strip width, temperature, etc.).

The setting calculation unit 1*c* determines, based on the base material information and the target information, at least a strip thickness target value of each stand, a gap setting value of each stand, and a roll circumferential speed setting value of each stand.

In addition, the setting calculation unit 1*c* calculates two parameters (entry side strip thickness influence coefficient $Q_i$ and roll force distribution ratio target value $\gamma_i^{AIM}$) described later, and outputs to the roll force distribution modification unit 1*g*.

Furthermore, the setting calculation unit 1*c* determines the use or non-use of roll force distribution control by the roll force distribution modification unit 1*g*.

The actual data collection unit 1*e* continuously collects from the rolling line 20: a roll force actual value of each stand; a gap actual value of each stand; a roll rotational speed actual value of each stand; and a strip thickness measurement value on a final stand (the N-th stand) delivery side.

Here, the roll force actual value is a calculation value that is calculated from either a measurement value obtained by measurement with each of load cells 3*d* or a measurement value obtained by measurement with a pressure gauge that measures pressure of each of hydraulic cylinders 3*c*.

The gap actual value is the size of a roll gap that is calculated from an amount by which the hydraulic cylinder 3*c* as an actuator controlling the roll gap is operated. The amount by which the hydraulic cylinder 3*c* is operated is based on a roll gap operation value. Thus, the gap actual value does not include a change in a roll diameter due to the amount of abrasion and amount of thermal expansion described above. Therefore, there is a deviation between the gap actual value and a gap true value that is the size of a real roll gap for which a change in a roll diameter due to the amount of abrasion and amount of thermal expansion of rolls is taken into consideration.

The roll rotational speed actual value is a work roll rotational speed which is measured by encoders 3*e*. A roll circumferential speed actual value is calculated from the roll rotational speed actual value.

The strip thickness measurement value is a measurement value obtained by measurement with a strip thickness gauge 2*c* that is provided on a delivery side of the tandem rolling mill 2.

The target strip thickness operation unit 1*f* changes, when there is a difference between the strip thickness measurement value and a strip thickness target value of a final stand during rolling, a strip thickness target value of each stand other than the final stand, which is set by the setting calculation unit 1*c*, so as to bring the difference to zero.

In addition, the target strip thickness operation unit 1*f* receives, when a tracking point which is set on the material to be rolled 2*b* reaches the i-th stand (1≤i≤N), an input of a target strip thickness correction value of the i-th stand from the roll force distribution modification unit 1*g* during the execution of the roll force distribution control described later. Then, the target strip thickness operation unit 1*f* corrects the strip thickness target value of the i-th stand with the target strip thickness correction value of the i-th stand. The corrected strip thickness target value is output to the gap operation unit 1*d*.

The roll force distribution modification unit 1*g* includes: a target strip thickness correction value calculation unit 1*h*, a mass flow thickness correction unit 1*i*, and a tracking unit 1*j*, for executing the roll force distribution control.

The roll force distribution modification unit 1*g* outputs, when a tracking point which is set on the material to be rolled 2*b* reaches the i-th stand, a gap correction value of the i-th stand to the gap operation unit 1*d* and a target strip thickness correction value of the i-th stand to the target strip thickness operation unit 1*f* during the execution of the roll force distribution control.

The target strip thickness correction value calculation unit 1*h* receives an input of a roll force distribution ratio target value of each stand which is set by the setting calculation unit 1*c* and a roll force actual value of each stand which is collected by the actual data collection unit 1*e*.

The target strip thickness correction value calculation unit 1*h* calculates a roll force distribution ratio actual value of each stand, which represents an actual roll force ratio between stands, based on the roll force actual value of each stand.

The target strip thickness correction value calculation unit 1*h* calculates a target strip thickness correction value of each stand, based on a difference between the roll force distribution ratio target value of each stand and a roll force distribution ratio actual value of each stand.

The mass flow thickness correction unit 1*i* calculates a strip thickness actual value of each stand, based on the strip thickness measurement value and the roll rotational speed actual value of each stand.

The mass flow thickness correction unit 1*i* calculates a strip thickness actual recalculation value of each stand, based on the roll force actual value of each stand and a gap actual value of each stand.

The mass flow thickness correction unit 1*i* calculates a gap error of each stand, based on a difference between the strip thickness actual value of each stand and the strip thickness actual recalculation value of each stand.

The mass flow thickness correction unit 1*i* calculates a gap correction value for each stand for preventing a gap error of each stand from varying. Here, the gap correction value is a correction value that brings to zero a difference between a head end gap error (correction reference gap error) when a head end of the material to be rolled 2*b* reaches the i-th stand (1≤i≤N) and a non-head-end gap error when a part other than the tip end of the material to be rolled 2*b* reaches the i-th stand.

The tracking unit 1*j* tracks a tracking point which is set on the material to be rolled 2*b*, based on the roll rotational speed actual value.

The gap operation unit 1*d* outputs, before start of rolling, an actuator control signal (roll gap operation value, roll rotational speed value) to the rolling line 20 so as to match the roll gap and roll circumferential speed of each stand with the setting values thereof. An actuator that controls the roll gap is each of the hydraulic cylinders 3*c*. An actuator that controls the roll circumferential speed is a drive device for work rolls.

The gap operation unit 1*d* outputs, during rolling, a roll gap operation value for bringing to zero a difference between the strip thickness target value of each stand and the strip thickness actual recalculation value of each stand, to the rolling line 20 (hydraulic cylinders 3*c*).

In addition, the gap operation unit 1*d* receives, when a tracking point reaches the i-th stand (target rolling stand), an input of a gap correction value of the i-th stand from the roll force distribution modification unit 1*g* during the execution of the roll force distribution control. At the same time, the gap operation unit 1*d* receives an input of the strip thickness target value of the i-th stand which has been corrected by the target strip thickness operation unit 1*f*.

Then, the gap operation unit 1*d* outputs, to the i-th stand, a roll gap operation value for bringing to zero a difference between the strip thickness target value of the i-th stand which has been corrected by the target strip thickness operation unit 1*f* and a value which has been obtained by correcting the strip thickness actual recalculation value of the i-th stand with the gap correction value of the i-th stand. The hydraulic cylinders 3*c* of the i-th stand change a roll gap based on the roll gap operation value.

Figure 8:
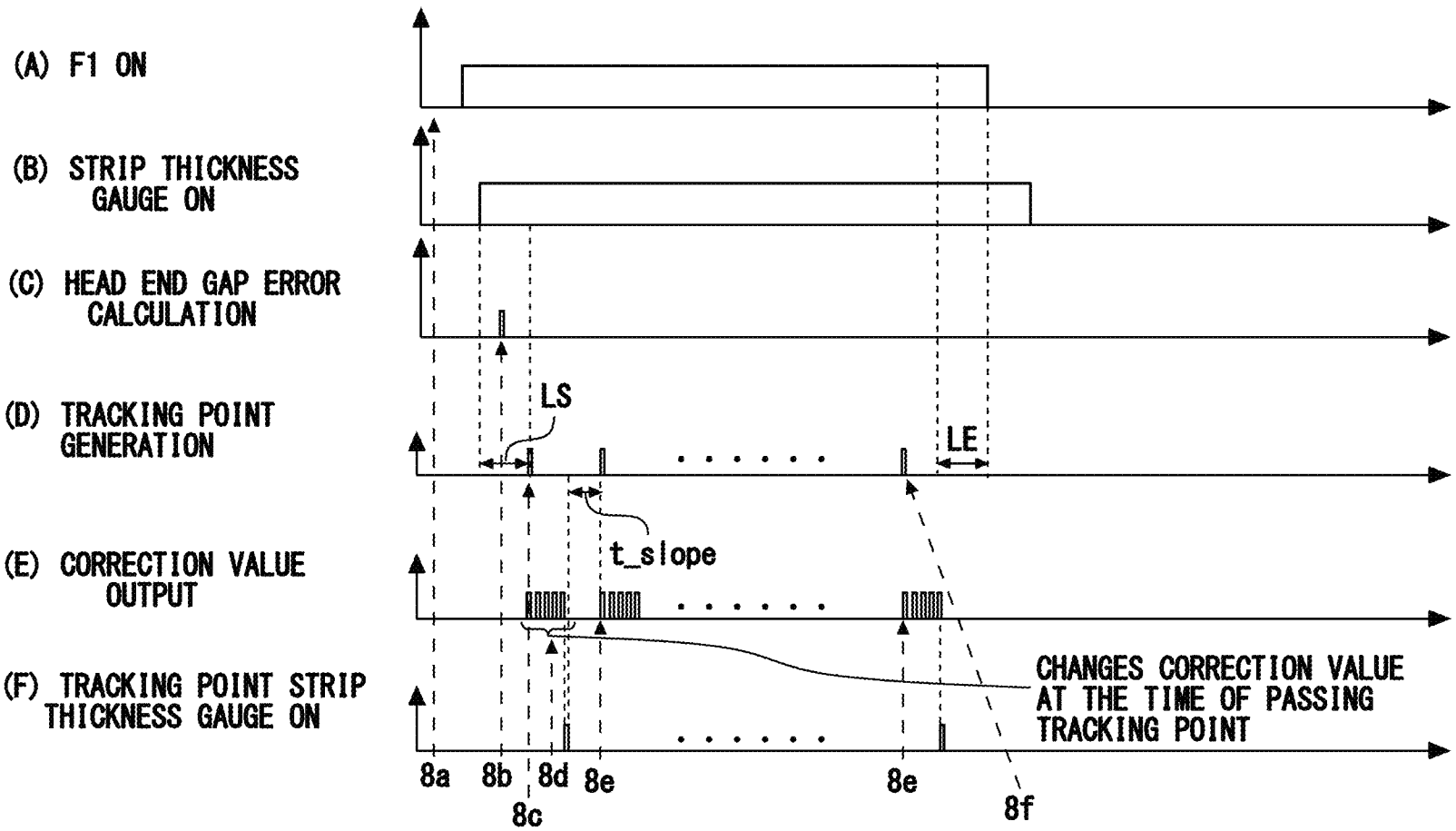
FIG. 8 is a diagram that shows control timings of the continuous rolling system according to the first embodiment.

Next, the operation of the continuous rolling system will be described with reference to FIG. 8 to FIG. 11. FIG. 8 is a diagram that shows control timings of the continuous rolling system. Details of the control timings and the control thereof will be described based on FIG. 1 and FIG. 8.

(Control Timing 8*a*: Setting Calculation)

The 8*a* is a timing before a material to be rolled reaches the most upstream stand (the first stand). At the control timing 8*a*, setting calculation is executed.

The setting calculation unit 1*c* receives an input of the base material information of the material to be rolled and the target information of the material to be rolled which are described above, from the operating instruction input unit 1*b*. The setting calculation unit 1*c* determines at least a gap setting value of each stand and a roll circumferential speed setting value of each stand, based on the base material information of the material to be rolled and the target information of the material to be rolled.

The gap operation unit 1*d* outputs an actuator control signal (roll gap operation value, roll rotational speed value) to the rolling line 20 so as to match the roll gap and roll circumferential speed of each stand with the setting values thereof.

The setting calculation unit 1*c* calculates two parameters which are required by the roll force distribution modification unit 1*g*. The two parameters are an entry side strip thickness influence coefficient $Q_i$ and a roll force distribution ratio target value $\gamma_i^{AIM}$.

The entry side strip thickness influence coefficient $Q_i$ is a value indicating the amount of change in roll force with respect to a change in a strip thickness and is represented by equation (9).

[Math. 9]

$$Q_i = \left(\frac{\partial P(T, H, h, V, \ldots)}{\partial h}\right)^{CAL} \tag{9}$$

where $Q_i$: an entry side strip thickness influence coefficient of the i-th stand The roll force distribution ratio target value $\gamma_i^{AIM}$ represents a target ratio of roll force of each stand. The roll force distribution ratio target value $\gamma_i^{AIM}$ is determined, for example, by using roll force which is predicted when the setting calculation unit 1*c* determines a roll gap, as in equation (10).

[Math. 10]

$$\gamma_1^{AIM}:\gamma_2^{AIM}:\gamma_3^{AIM}:\ldots:\gamma_i^{AIM}:\ldots:\gamma_N^{AIM}:=P_1^{Pre}:P_2^{Pre}:P_3^{Pre}:\ldots:P_i^{Pre}:\ldots:P_N^{Pre} \tag{10}$$

where $P_i^{Pre}$: a roll force prediction value of the i-th stand [kN]

$\gamma_i^{AIM}$: a roll force distribution ratio target value of the i-th stand [-]

The entry side strip thickness influence coefficient $Q_i$ and the roll force distribution ratio target value $\gamma_i^{AIM}$ are used in calculation of a target strip thickness correction value $\Delta h^{BAL}$ (i) by the roll force distribution modification unit 1*g* (target strip thickness correction value calculation unit 1*h*) described later.

After the control timing 8*a*, the material to be rolled 2*b* is conveyed from the upstream side of the rolling line 20 and rolling starts.

The actual data collection unit 1*e* continues collecting measurement data including a roll force actual value of each stand; a roll rotational speed actual value of each stand, a strip thickness measurement value on a final stand delivery side, from the start of rolling to the end of rolling.

The target strip thickness operation unit 1*f* changes during rolling, when there is a difference between the strip thickness measurement value and the strip thickness target value of a final stand, the strip thickness target value of each stand (the first stand to the N−1-th stand) so as to bring the difference to zero. The corrected strip thickness target value is output to the gap operation unit 1*d*.

The gap operation unit 1*d* outputs, during rolling, a roll gap operation value for bringing to zero a difference between the strip thickness target value of each stand and the strip thickness actual recalculation value of each stand, to the rolling line 20 (hydraulic cylinders 3*c*). Each of the hydraulic cylinders 3*c* change a roll gap, based on the roll gap operation value.

(Control Timing 8*b*: Calculation of Correction Reference Gap Error)

The 8*b* is a timing at which after passing sequentially from the most upstream stand to the final stand, the head end of the material to be rolled 2*b* further reaches the strip thickness gauge 2*c*.

At the control timing 8*b*, the mass flow thickness correction unit 1*i* calculates a correction reference gap error of each stand. The correction reference gap error is a gap error (head end gap error) when the head end of the material to be rolled 2*b* reaches the i-th stand (1≤i≤N).

More specifically, the mass flow thickness correction unit 1*i* calculates a correction reference gap error $S^{OFS}$(i) of each stand, based on a difference between a strip thickness actual value when the head end of the material to be rolled 2*b* passes through the i-th stand and the strip thickness actual recalculation value of the i-th stand.

The strip thickness actual recalculation value $h^{GM}$(i) is calculated as in equation

[Math. 11]

$$h^{GM}(i)=S_i^{act}+P_i^{act}/M_i\alpha_i \tag{11}$$

where $S_i^{act}$: a gap actual value of the i-th stand [mm]

$P_i^{act}$: a roll force actual value of the i-th stand [kN]

$\alpha_i$: an offset value of the i-th stand (for example, a gap learning value) [mm]

When a strip thickness gauge is placed on a stand delivery side, the strip thickness actual value $h^{MF}$(i) is a measurement value of the strip thickness gauge. When a strip thickness gauge is not placed on a stand delivery side, the strip thickness actual value $h^{MF}$(i) is calculated from a roll circumferential speed actual value, a strip thickness measurement value on the final stand delivery side, and a forward slip ratio, as shown in equation (12).

[Math. 12]

$$h^{MF}(i)=h^{MES}(N)\cdot(1+fs^{ACAL}(N)\cdot V^{ACT}(N)/(1fs^{ACAL}(i)/V^{ACT}(i) \tag{12}$$

where $V^{ACT}$(i): a roll circumferential speed actual value of the i-th stand [mm]

$h^{MES}$(N): a strip thickness measurement value on the N-th stand (final stand) delivery side [mm]

$fs^{ACAL}$(i): a forward slip ratio of the i-th stand [-]

where, the roll circumferential speed actual value is the one collected at the same time for all stands. The strip thickness measurement value is a measurement value of the strip thickness gauge 2*c* that is placed on the final stand delivery side. The forward slip ratio $fs^{ACAL}$(i) is a ratio between a roll circumferential speed and a roll delivery side material-to-be-rolled speed; and changes according to at least a draft which is represented by a ratio between the amount of strip thickness change and entry side strip thickness of a stand.

[Math. 13]

$$fs^{ACAL}(i_=fs((h^{MF}(i-1)-h^{MF}(i)/h^{MF}(i-1), \ldots) \tag{13}$$

When a strip thickness actual value changes, a forward slip ratio changes, and when the forward slip ratio changes, the strip thickness actual value changes; and therefore, the strip thickness actual value described above can be obtained by performing convergent calculation.

As described above, the strip thickness actual recalculation value can be calculated from equation (11). The strip thickness actual value can be obtained by a convergent calculation between equation (12) and equation (13). Therefore, the correction reference gap error $S^{OFS}$(i) is calculated as in equation (14).

[Math. 14]

$$S^{OFS}(i)=h^{GM_hd}(i)-h^{MF_hd}(i) \tag{14}$$

The $h^{GM_hd}(i)$ in equation (14) is represented by equation (15).

[Math. 15]

$$h^{GM_hd}(i)=S_i^{adct_hd}+P_i^{act_hd}/M_i+\alpha_i \quad (15)$$

where $h^{GM_hd}(i)$: a strip thickness actual recalculation value at the head end of a material to be rolled on the i-th stand [mm]

$S_i^{act_hd}$: a gap actual value at the head end of the material to be rolled on the i-th stand [mm]

$P_i^{act_hd}$: a roll force actual value at the head end of the material to be rolled on the i-th stand [mm]

$\alpha_i$: an offset value of the i-th stand (for example, a gap learning value) [mm]

The $h^{MF_hd}(i)$ in equation (14) is represented by equation (16).

[Math. 16]

$$h^{MF_hd}(i)=h^{MES_hd}(N)\cdot(1+fs^{ACAL_hd}(N))\cdot V^{ACT_hd}(N)/(1+fs^{ACL_hd}(i))/V^{ACT_hd}(i) \quad (16)$$

The $fs^{ACAL_hd}(i)$ in equation (16) is represented by equation (17).

[Math. 17]

$$fs^{ACAL_hd}(i)=fs((h^{MF_hd}(i-1)-h^{MF_hd}(i))/h^{MF_hd}(i-1), \ldots) \quad (17)$$

where $h^{MF_hd}(i)$: a strip thickness actual value at the head end of a material to be rolled on the i-th stand [mm]

$V^{ACT_hd}(i)$: a roll circumferential speed at the head end of the material to be rolled on the i-th stand (collected at timing 8*b*) [m/s]

$h^{MES_hd}(N)$: a strip thickness measurement value at the head end of the material to be rolled on the N-th stand (final stand) delivery side [mm]

$fs^{ACAL_hd}(i)$: a forward slip ratio of the i-th stand [-]

(Control Timing 8*c*: Calculation of a Gap Correction Value and a Target Strip Thickness Correction Value)

In recent years, coils of thin size have been manufactured. In rolling for a thin size, if an abrupt load change and a speed balance change occur due to an abrupt gap change, rolling becomes unstable due to shape irregularities and a deterioration of tension between stands, where a serious trouble such as strip breakage is more likely to occur. Therefore, it is not preferable to abruptly change a gap immediately after passing of a material to be rolled, immediately after a size change, or the like.

For these reasons, the roll force distribution control is not performed immediately after the start of strip thickness measurement since rolling at a head end non-steady part is performed then. The roll force distribution modification unit 1*g* executes the roll force distribution control, for example, after the head end of the material to be rolled 2*b* has passed LS[m] since reaching the strip thickness gauge 2*c*. In the roll force distribution control, a gap correction value and a target strip thickness correction value are calculated.

The 8*c* is a control timing at which correction value calculation starts. It is no problem whether a calculation timing of a gap correction value by the mass flow thickness correction unit 1*i* and a calculation timing of a target strip thickness correction value by the target strip thickness correction value calculation unit 1*h* are simultaneous or either of them precedes the other. Here, an example where the calculations are simultaneously performed is described.

First, the calculation of a gap correction value will be described. The mass flow thickness correction unit 1*i* calculates a gap correction value of each stand, based on a difference between the strip thickness actual value of each stand and the strip thickness actual recalculation value of each stand.

First, the mass flow thickness correction unit 1*i* calculates a gap error $S^{EER}(i)$, based on the strip thickness actual recalculation value $h^{GM}(i)$ which is calculated by using equation (11) and the strip thickness actual value $h^{MF}(i)$ which is calculated by using equation (12) (equation (18)). The gap error $S^{EER}(i)$ is a non-head-end gap error when a part other than the head end of the material to be rolled 2*b* reaches the i-th stand.

In addition, the mass flow thickness correction unit 1*i* determines the amount of change in a gap error from the head end by comparing this gap error SEER(i) and the above-described correction reference gap error $S^{OFS}(i)$ by using the equation (20). The mass flow thickness correction unit 1*i* calculates a gap correction value for bringing the amount of change in the gap error to zero. The mass flow thickness correction unit 1*i* applies an adjustment gain as shown in equation (21) and performs a limit check with the maximum value and minimum value of an output as shown in equation (22), thereby determining a final gap correction value $\Delta S^{COMP}(i)$.

[Math. 18]

$$S^{ERR}(i)=h^{GM}(i)-h^{MF}(i) \quad (18)$$

[Math. 19]

$$S^{ERR_PREV}(i)=S^{ERR}(i) \quad (19)$$

[Math. 20]

$$\mathrm{err}(i)=S^{ERR}(i)-S^{OFS}(i) \quad (20)$$

[Math. 21]

$$\Delta S^{COMP}(i)=G^{SCOMP}(i)\cdot\{\Delta S^{COMP_Prev}(i)+\beta(i)\cdot\mathrm{err}(i)\} \quad (21)$$

[Math. 22]

$$\Delta S^{COMP}(i)=\mathrm{Clamp}(\Delta S^{COMP}(i),\Delta S^{COMP_UL}(i)\ \Delta S^{COMP_LL}(i)) \quad (22)$$

where $\Delta S^{COMP_Prev}(i)$: a previous output value of the i-th stand (initial value is 0)

$\beta(i)$: an update gain of the i-th stand [-]

$G^{SCOMP}(i)$: a correction output gain of the i-th stand [-]

$\Delta S^{COMP_UL}(i)$: a gap correction upper limit value of the i-th stand [mm]

$\Delta S^{COMP_LL}(i)$: a gap correction lower limit value of the i-th stand [mm]

$S^{ERR}(i)$: a gap error of the i-th stand [mm]

$\Delta S^{COMP}(i)$: a gap correction value of the i-th stand [mm]

The strip thickness actual recalculation value $h^{GM}(i)$ after correction which is shown by equation (23) is a value obtained by subtracting the above gap correction value $\Delta S^{COMP}(i)$ which has been output, from the strip thickness actual recalculation value $h^{GM}(i)$ shown by equation (11).

[Math. 23]

$$h^{GM}(i)=S_i^{act}+P_i^{act}/M_i+\alpha_i-S^{COMP}(i) \quad (23)$$

Next, the calculation of a target strip thickness correction value will be described. The target strip thickness correction value calculation unit 1*h* calculates a target strip thickness correction value $\Delta h^{BAL}(i)$ by comparing a current roll force actual value $P_i^{act}$ and a roll force distribution ratio target value $\gamma_i^{AIM}$, so as to bring the roll force distribution ratio actual value close to the roll force distribution ratio target value $\gamma_i^{AIM}$. For example, the target strip thickness correction value $\Delta h^{BAL}(i)$ is calculated by using the following equation.

[Math. 24]

$$\Delta h_{i-1}^{BAL0} = -\frac{1}{Q_i}\left(P_i^{ACT} - A \cdot \gamma_i^{AIM}\right) + \Delta h_i^{BAL0} \tag{24}$$

[Math. 25]

$$A = \frac{\frac{P_1^{ACT}}{Q_1} + \frac{P_2^{ACT}}{Q_2} + \ldots + \frac{P_5^{ACT}}{Q_5}}{\frac{\gamma_1^{AIM}}{Q_1} + \frac{\gamma_2^{AIM}}{Q_2} + \ldots + \frac{\gamma_5^{AIM}}{Q_5}} \tag{25}$$

The coefficient A is common to all stands. $Q_i$ and $\Delta_i^{AIM}$ are calculated in advance by using the equation (9) and the equation (10) by the setting calculation unit 1*c*. where, $\Delta h_i^{BAL0}$ in equation (24) is zero for the final stand $F_N$ as shown in equation (26) and is calculated sequentially from a latter stand.

[Math. 26]

$$\begin{aligned} &\Delta h_N^{BAL0} = 0 \\ &\Delta h_{N-1}^{BAL0} = -\frac{1}{Q_N}\left(P_N^{ACT} - A \cdot \gamma_N^{AIM}\right) + \Delta h_N^{BAL0} \\ &\ldots \\ &\Delta h_1^{BAL0} = -\frac{1}{Q_2}\left(P_2^{ACT} - A \cdot \gamma_2^{AIM}\right) + \Delta h_2^{BAL0} \end{aligned} \tag{26}$$

The target strip thickness correction value calculation unit 1*h* applies an adjustment gain as shown in equation (27) and performs a limit check as shown in equation (28), thereby determining a final target strip thickness correction value $\Delta h^{BAL}(i)$.

[Math. 27]

$$dh = G^{BAL}(i) \cdot \{\Delta h^{BAL_Prev}(i) + \beta(i) \cdot \Delta h^{BAL0}(i)\} \tag{27}$$

[Math. 28]

$$\Delta h^{BAL}(i) = \mathrm{Clamp}(dh, \Delta h^{BAL_UL}(i), \Delta h^{BAL_LL}(i)) \tag{28}$$

[Math. 29]

$$\Delta h^{BAL_Prev}(i) = \Delta h^{BAL}(i) \tag{29}$$

where $\Delta h^{BAL_Prev}(i)$: a previous value of the i-th stand (initial value=0) [mm]

$\Delta h^{BAL}(i)$: a target strip thickness correction value of the i-th stand [mm]

$\beta(i)$: an update gain of the i-th stand (adjustment value, for example, 0.3) ($0 \le \beta \le 1.0$)

$G^{BAL}(i)$: a correction output gain of the i-th stand (adjustment value, for example, 0.5) ($0 \le G^{BAL}(i) \le 1.0$)

As described above, during the execution of the roll force distribution control, the mass flow thickness correction unit 1*i* calculates a gap correction value of each stand and the target strip thickness correction value calculation unit 1*h* calculates a target strip thickness correction value of each stand.

(Control Timing 8*d*: Correction of a Delivery Side Strip Thickness Target Value and Correction of a Strip Thickness Actual Recalculation Value, Using a Tracking Function)

Next, by using the tracking unit 1*j*, the above target strip thickness correction value calculated by the target strip thickness correction value calculation unit 1*h* and the above gap correction value calculated by the mass flow thickness correction unit 1*i* are output to the target strip thickness operation unit 1*f* and the gap operation unit 1*d*, respectively, sequentially from an upstream side stand.

The 8*d* is a control timing at which a gap correction value and target strip thickness correction value of the most upstream stand are output during the execution of roll force distribution control. At the control timing 8*d*, the gap correction value and target strip thickness correction value of the most upstream stand are output.

Simultaneously, the tracking unit 1*j* sets a tracking point on the material to be rolled 2*b* positioned on the most upstream stand. The tracking unit 1*j* tracks the tracking point, based on the roll rotational speed actual value. The roll force distribution modification unit 1*g* outputs, when the tracking point reaches a downstream side stand, a gap correction value and target strip thickness correction value of the downstream side stand.

The target strip thickness operation unit 1*f* corrects a strip thickness target value of the i-th stand with a target strip thickness correction value of the i-th stand. The corrected strip thickness target value is output to the gap operation unit 1*d*.

The gap operation unit 1*d* outputs, to the i-th stand, a roll gap operation value for bringing to zero a difference between the strip thickness target value of the i-th stand which has been corrected by the target strip thickness operation unit 1*f* and a value which has been obtained by correcting the strip thickness actual recalculation value of the i-th stand with the gap correction value of the i-th stand (equation (23)). The hydraulic cylinder 3*c* of the i-th stand changes a roll gap, based on the roll gap operation value.

Figure 9:
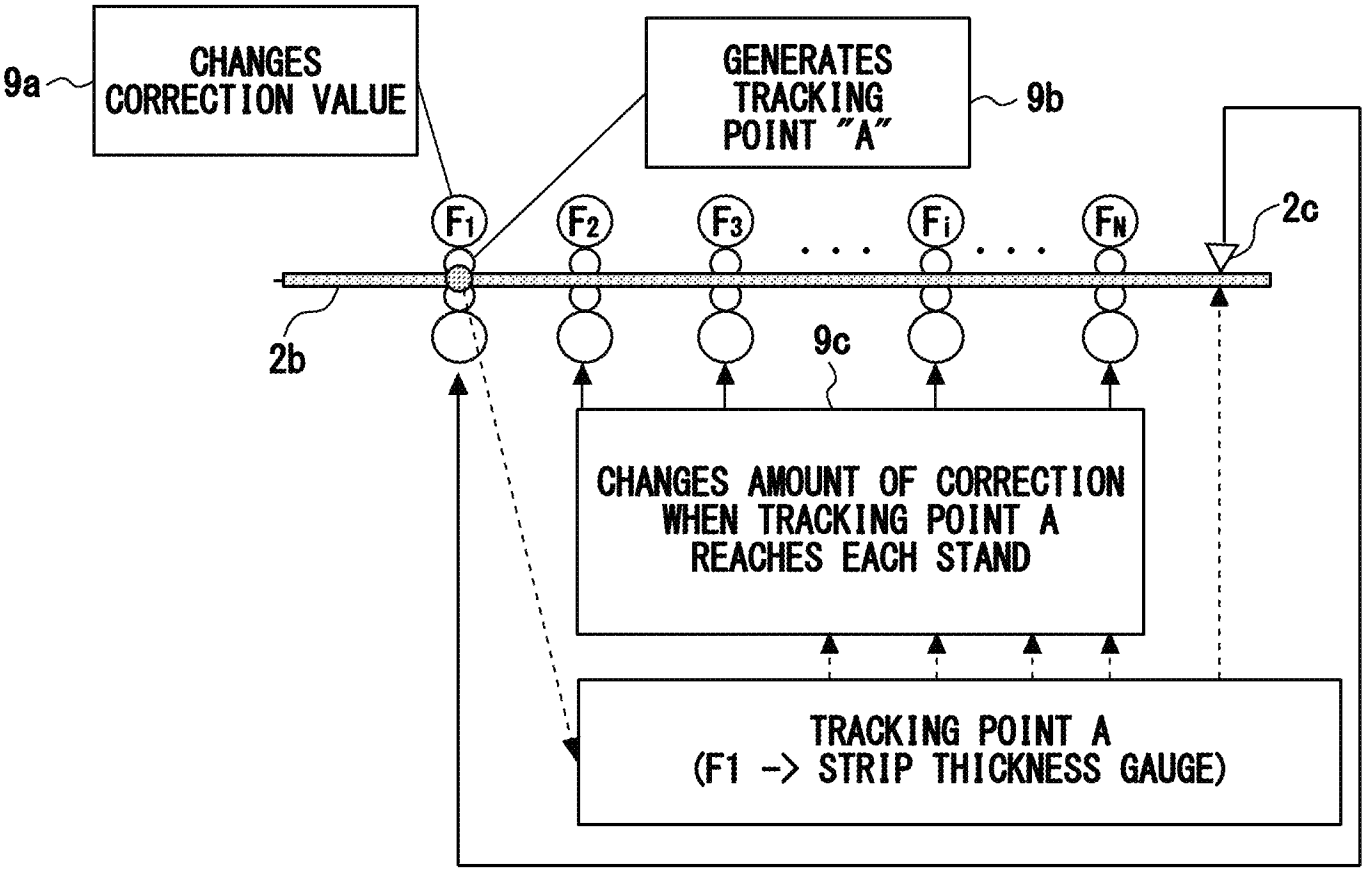
FIG. 9 is a diagram for describing an output timing of a correction value according to a position of a tracking point.

FIG. 9 is a diagram for describing an output timing of a correction value according to the position of the tracking point. First, a gap correction value $\Delta S^{COMP}(1)$ and target strip thickness correction value $\Delta h^{BAL}(1)$ of the first stand $F_1$ (the most upstream stand) are output (9*a*). At this time, a part of the material to be rolled 2*b* positioned on the first stand F1 is set as a tracking point A (9*b*). When the tracking point A reaches the second stand $F_2$, a gap correction value $\Delta S^{COMP}(2)$ and target strip thickness correction value $\Delta h^{BAL}(2)$ of the second stand $F_2$ is output. Subsequently, when the tracking point A reaches the i-th stand on a downstream side, a gap correction value $\Delta S^{COMP}(i)$ and target strip thickness correction value $\Delta h^{BAL}(i)$ of the i-th stand are output (9*c*). The tracking unit 1*j* performs tracking until the tracking point A reaches the strip thickness gauge 2*c* on the N-th stand (final stand) delivery side. Note that the processing order of 9*a* and 9*b* may be in reverse.

(Control Timing 8*e*: Repetition of Control)

When a roll gap is operated according to calculation of a gap correction value and a target strip thickness correction value by the above-described roll force distribution control, fluctuations occur in a roll force actual value, a tension detection value between stands, and the like. Since these fluctuations are disturbances in control, the roll force distribution modification unit 1*g* does not recalculate a correction value until the fluctuations subside to a certain degree and after a given period of time has passed, recalculates a correction value.

The 8*e* in FIG. 8 is a control timing after a given period of time t_slope has passed since the tracking point has reached the strip thickness gauge 2*c*. For example, at the control timing 8*e*, a gap correction value and a target strip thickness correction value are determined again; a tracking point is created at the same time when a correction value of the most upstream stand to be operated is changed; and a correction value is changed sequentially from an upstream side stand. Subsequently, the control is continued until a control end timing comes.

(Control Timing 8*f*: End of Control)

The 8*f* in FIG. 8 is a control timing at which the roll force distribution control is ended. At a tail end of the material to be rolled 2*b*, rolling tends to be unstable and therefore, the gap correction value and the target strip thickness correction value are not changed. For example, when the tail end is positioned LE [m] before passing through the most upstream stand to be operated, the roll force distribution modification unit 1*g* neither calculates a correction value nor generate a tracking point. Subsequently, the control is not performed until rolling ends.

In the present embodiment, a timing of changing a gap correction value by the mass flow thickness correction unit 1*i* and a timing of changing a target strip thickness correction value by the target strip thickness correction value calculation unit 1*h* are the same timing; however, these timings can be staggered. For example, a gap correction value is set to be changed several seconds after a target strip thickness correction value has been changed, thereby the timings for respective changes of a gap and strip thickness can be staggered.

(Work and Effect)

As described above, according to the roll force distribution control device 10, a tracking point is tracked and a gap correction value and a target strip thickness correction value are applied sequentially from an upstream side stand. By applying a gap correction value, a change in a gap error is prevented. By applying a target strip thickness correction value, a strip thickness target value on a stand delivery side is corrected so as to bring a roll force distribution ratio actual value close to a roll force distribution ratio target value.

Accordingly, an actual roll force ratio between all stands is matched with a target roll force ratio during continuous rolling, thereby a stable rolling can be achieved.

Figure 10:
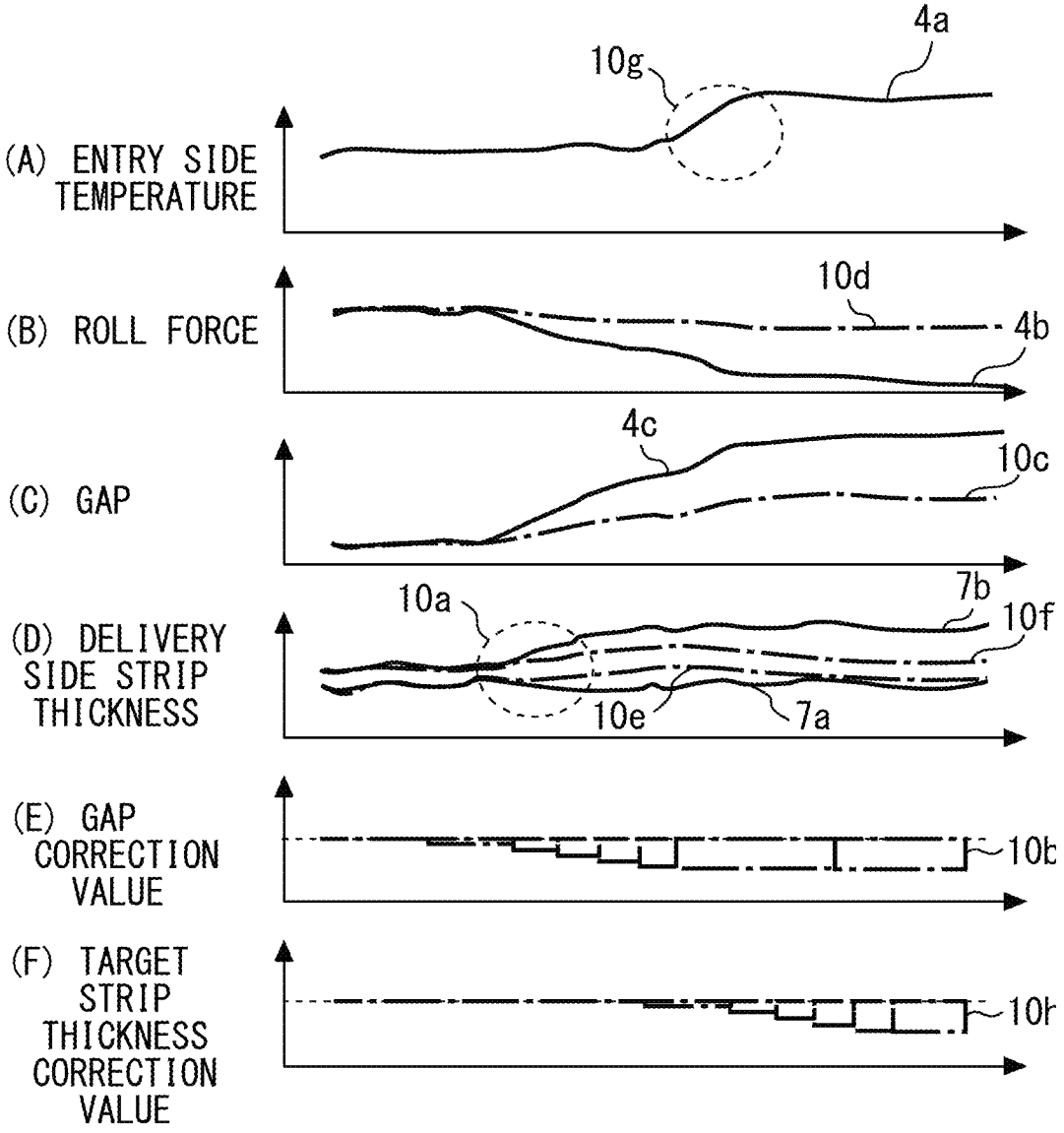
FIG. 10 is a diagram that shows a control result over a total length of a material to be rolled on an upstream side stand.
Figure 11:
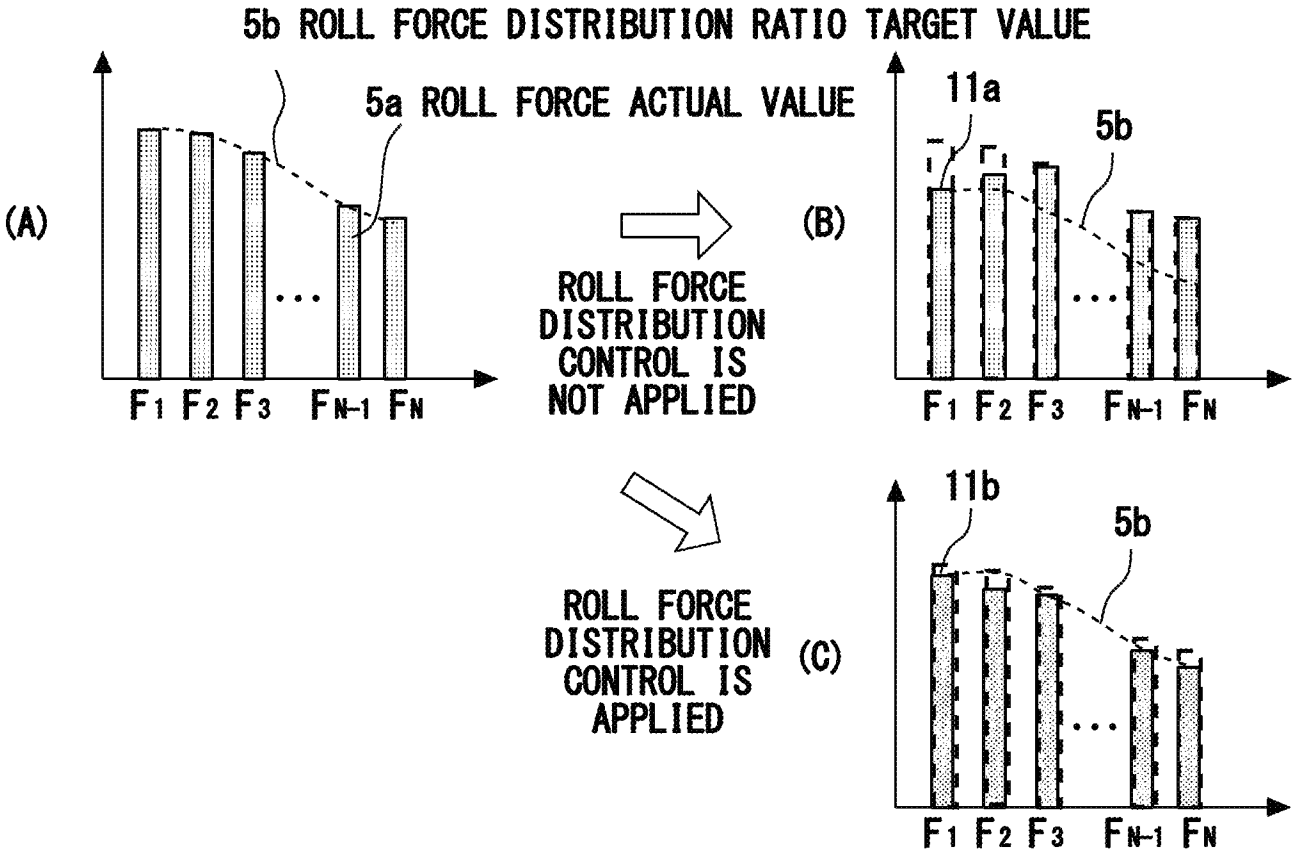
FIG. 11 is a diagram that shows examples of roll force actual values at the start time of rolling and before the end of rolling.

With reference to FIG. 10 and FIG. 11, one example of a control result when the roll force distribution control in the present embodiment is applied will be described.

FIG. 10 is a diagram that shows a control result over a total length of the material to be rolled 2*b* on an upstream side stand. An example shown in FIG. 10 is a case where a gap error that is a difference between a strip thickness actual value and a strip thickness actual recalculation value increases during rolling (10*a*) and after that, a mill entry side temperature rises (10*g*). Solid lines (4*b*, 4*c*, 7*a*, 7*b*) in FIG. 10 show control results when the roll force distribution control is not applied. Alternate long and short dash lines (10*b*, 10*c*, 10*d*, 10*e*, 10*f*, 10*h*) show control results when the roll force distribution control is applied.

First, a case where a gap error increases (10*a*) will be described.

In a case where a gap error that is a difference between the strip thickness actual value 7*b* and the strip thickness actual recalculation value 7*a* increases (10*a*), if the roll force distribution control is not applied, the roll force actual value 4*b* abruptly decreases and the gap actual value 4*c* increases.

On the other hand, when the roll force distribution control is applied, the mass flow thickness correction unit 1*i* calculates a gap correction value 10*b* for reducing the amount of change in the gap error, based on equation (22). More specifically, by increasing the gap correction value 10*b* in a minus direction, the gap operation unit 1*d* controls a rolling stand so as to reduce a roll gap. As a result of applying the roll force distribution control, an increase in the gap actual value 10*c* can be prevented and an abrupt decrease in the roll force actual value 10*d* can be prevented. At this time, the strip thickness actual recalculation value 10*e* based on equation (23) is prevented from decreasing in comparison with the strip thickness actual recalculation value 7*a* for which the roll force distribution control is not applied. In addition, the strip thickness actual value 10*f* for which the roll force distribution control is applied is prevented from increasing in comparison with the strip thickness actual value 7*b* for which the roll force distribution control is not applied. As a result, the amount of change in the gap error is reduced.

Next, a case where a mill entry side temperature rises (10*g*) will be described.

When a mill entry side temperature 4*a* increases (10*g*), roll force required for rolling the material to be rolled 2*b* decreases. Therefore, when the roll force distribution control is not applied, the roll force actual value 4*b* decreases. Since a final stand delivery side temperature is kept constant by finishing temperature control, the amount of decrease in the roll force of a latter stand is not as much as that of an upstream stand. Therefore, a roll force distribution ratio changes.

On the other hand, when the roll force distribution control is applied, the roll force actual values of all stands are compared and for a stand where a roll force distribution ratio actual value is smaller than a roll force distribution ratio target value, a target strip thickness correction value 10*h* for reducing a strip thickness target value is output. As a result, the gap operation unit 1*d* controls the rolling stand so as to reduce a roll gap. As a result of applying the roll force distribution control, an increase in the gap actual value 10*c* can be prevented and a decrease in the roll force actual value 10*d* can be prevented.

FIG. 11 is a diagram that shows examples of roll force actual values at the start time of rolling and before the end of rolling.

FIG. 11(A) is a graph that shows a roll force actual value 5*a* and a roll force distribution ratio target value 5*b* of each stand at the start time of rolling. When rolling starts, a roll force distribution ratio actual value which is calculated from the roll force actual value 5*a* of each stand matches the roll force distribution ratio target value 5*b*.

FIG. 11(B) is a graph that shows a roll force actual value of each stand before the end of rolling in a case where the roll force distribution control is not applied. When the roll force distribution control is not applied, control to keep the roll force distribution ratio actual value to the roll force distribution ratio target value 5*b* is not performed and therefore, the roll force actual value 11*a* of an upstream side stand shows a significant decrease in the roll force actual value of the upstream side stand due to an increase in a mill entry side temperature. The roll force of a downstream side stand does not change or on the contrary, increases under the influence of a gap error, in some cases.

FIG. 11(C) is a graph that shows a roll force actual value of each stand before the end of rolling in a case where the roll force distribution control is applied. In a case where the roll force distribution control is applied, a strip thickness target value of an upstream side stand is reduced, so that a decrease in the roll force actual value 11*b* of the upstream side stand can be prevented. By correcting a strip thickness target value of each stand, the roll force distribution ratio actual value can be kept to a roll force distribution ratio target value.

Second Embodiment

Figure 12:
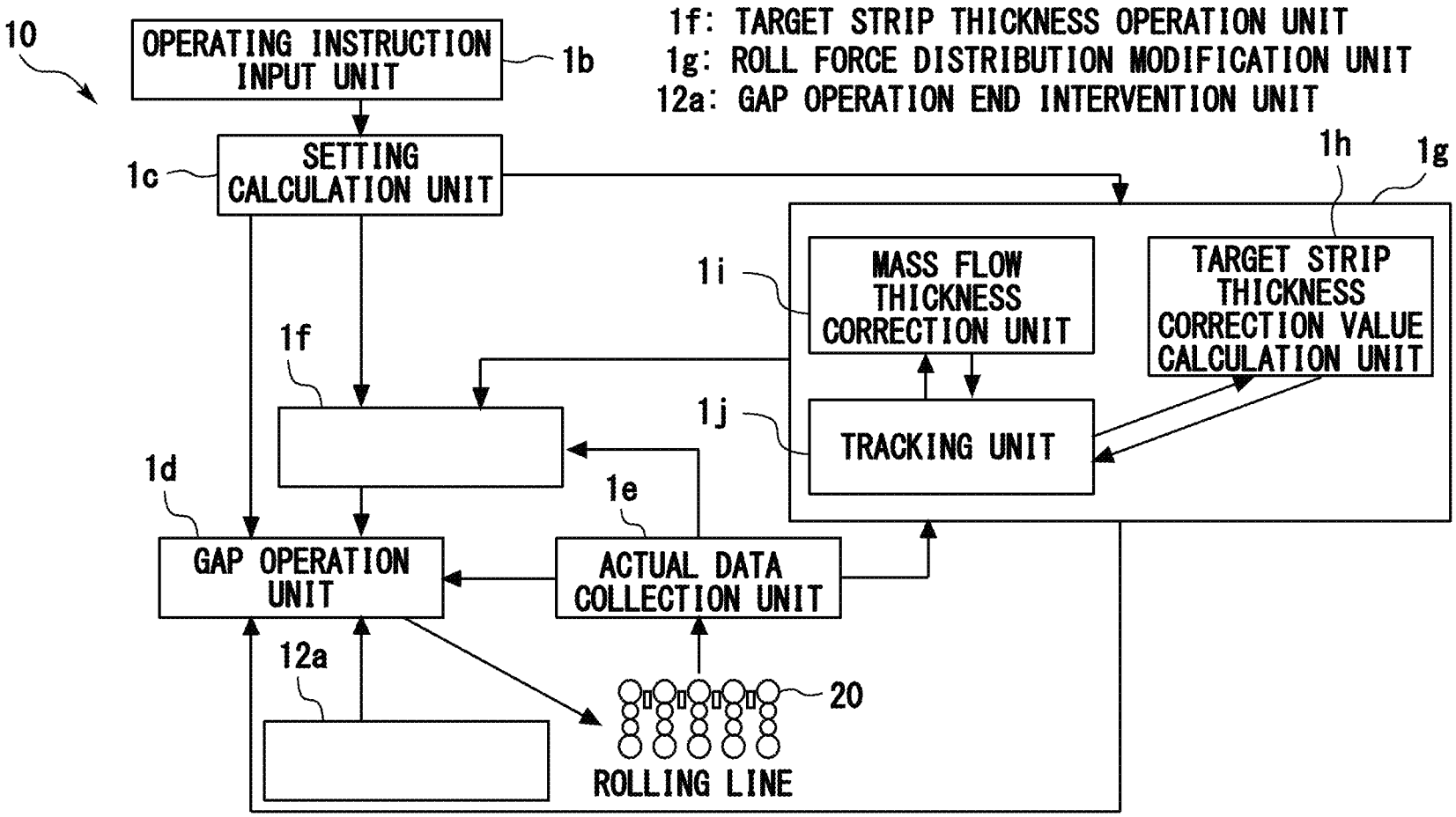
FIG. 12 is a diagram for describing a system configuration of a continuous rolling system according to a second embodiment.

FIG. 12 is a diagram for describing a system configuration of a continuous rolling system according to a second embodiment of the present disclosure. The roll force distribution control device 10 according to the second embodiment includes a gap operation end intervention unit 12*a* in addition to the configuration shown in FIG. 1 described above. The gap operation end intervention unit 12*a* changes a roll gap operation value based on an intervention signal by an operator. More specifically, the gap operation end intervention unit 12*a* allows an operator to directly operate a roll gap.

If a roll gap operation value is changed by the gap operation end intervention unit 12*a*, changing of a gap correction value and a target strip thickness correction value by the roll force distribution control described above is temporarily suspended. Several seconds after the end of intervention, the roll force distribution target value is redetermined and changing the correction values by the roll force distribution control is resumed.

Figure 13:
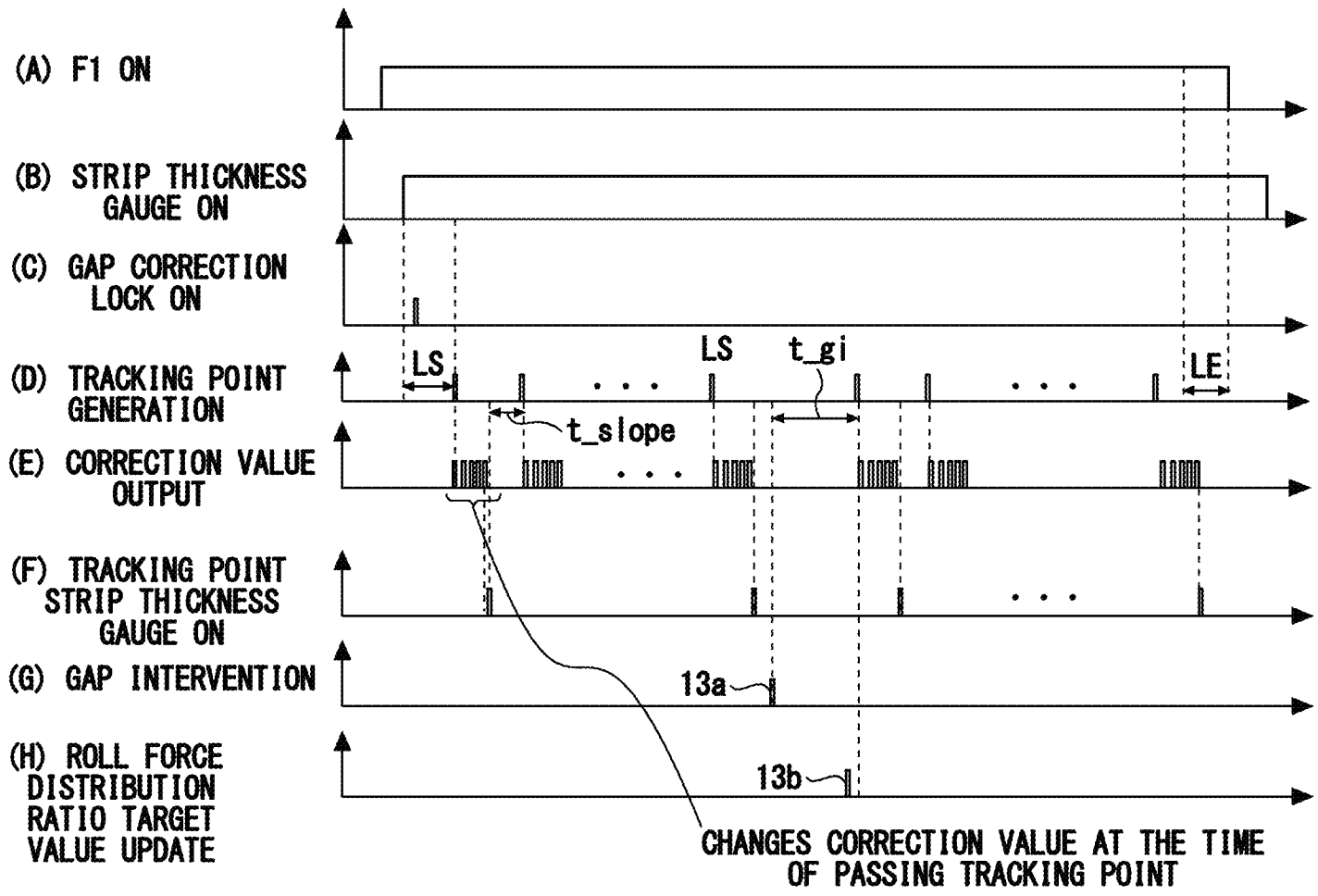
FIG. 13 is a diagram for describing roll force distribution control after gap intervention in the second embodiment.

FIG. 13 is a diagram for describing the roll force distribution control after gap intervention. When a gap intervention in which a roll gap operation value is changed by an operator occurs (13*a*), a tension between stands changes due to a change in a gap and fluctuations of a force actual value occur. Therefore, the roll force distribution control device 10 stops the roll force distribution control; and neither changes the correction values nor generates a tracking point for t_gi seconds after the gap intervention.

The roll force distribution control device 10 calculates a roll force distribution ratio actual value from a roll force actual value after the gap intervention, immediately before starting the roll force distribution control after t_gi seconds have has passed. In addition, the roll force distribution control device 10 sets this roll force distribution ratio actual value as a new roll force distribution ratio target value. After that, calculation of the correction values by the roll force distribution control is resumed (13*b*).

[Math. 30]

$$\gamma_1^{AIM}:\gamma_2^{AIM}:\gamma_3^{AIM}:\ldots:\gamma_i^{AIM}:\ldots:\gamma_N^{AIM}:=P_1^{Act}:P_2^{Act}:P_3^{Act}:\ldots:P_i^{Act}:\ldots:P_N^{Act} \tag{30}$$

where $P_i^{Act}$: a roll force actual value of the i-th stand before resumption of control [kN]

$\gamma_i^{AIM}$: a roll force distribution ratio target value of the i-th stand [-]

Figure 14:
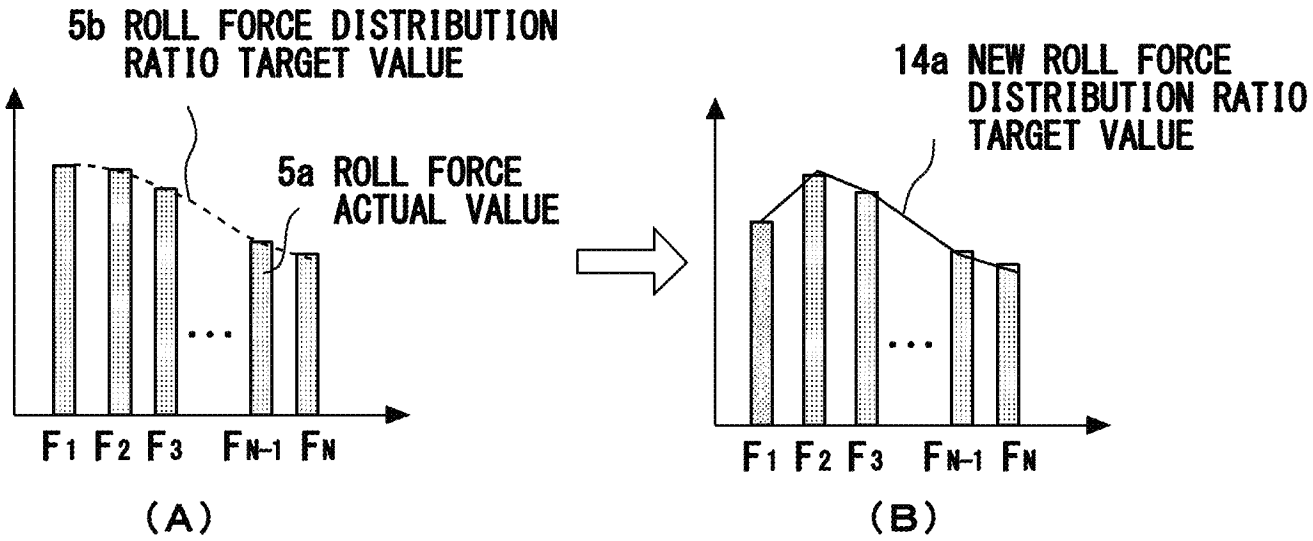
FIG. 14 is a diagram for describing an example of modifying a roll force distribution ratio target value at the time of the gap intervention in the second embodiment.

FIG. 14 is a diagram for describing an example of modifying a roll force distribution ratio target value at the time of gap intervention. In this example, the roll gap of the most upstream stand is increased to reduce a roll force actual value. The gap intervention is performed when a strip shape between stands and a stand condition are poor and therefore, a new roll force distribution ratio target value after the gap intervention is determined based on a roll force actual value that has changed due to the gap intervention as indicated by 14*a*. The roll force distribution control is executed so as to keep this new roll force distribution ratio target value.

As described above, for a given period of time after the gap intervention, the correction values are not changed; and after a stable state is obtained, a new roll force distribution target value is determined and the roll force distribution control is resumed. Thus, the roll force distribution is kept constant, allowing a stable rolling to be achieved.

Third Embodiment

The continuous rolling system can execute flying strip thickness change (flying gauge change: FGC) during rolling. When the flying strip thickness change is executed, the target value of product stripe thickness that is a stripe thickness target value on a final stand delivery side is changed without stopping rolling by the tandem rolling mill 2. According to the strip thickness target value on the final stand delivery side, a strip thickness target value of each stand is changed. A roll gap of each stand is changed sequentially from an upstream side stand so as to achieve the strip thickness target value of each stand.

Figure 15:
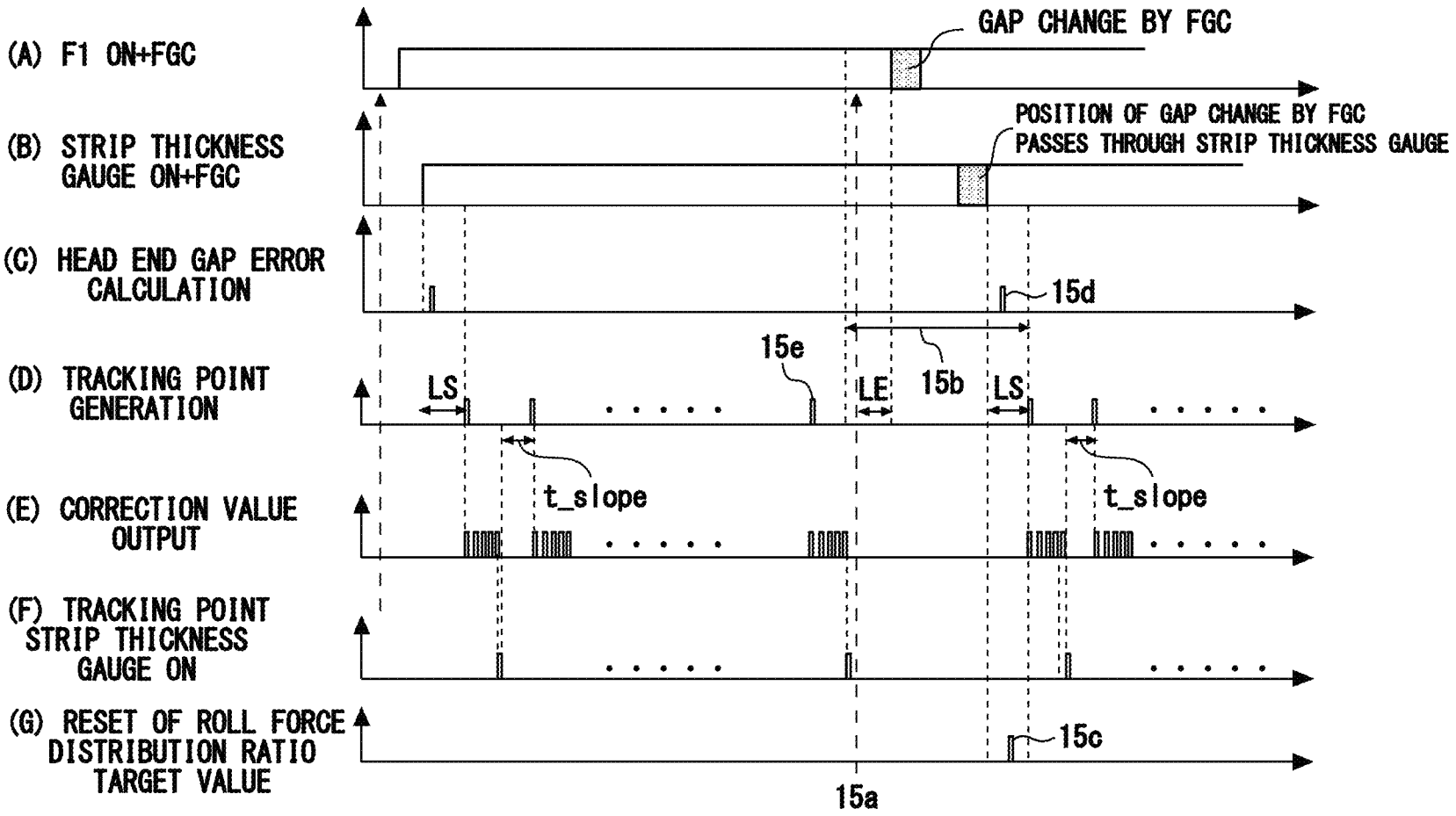
FIG. 15 is a diagram that shows control timings of a continuous rolling system according to a third embodiment.

FIG. 15 is a diagram that shows control timings of the continuous rolling system when the flying strip thickness change is executed. Before a gap change by the flying strip thickness change is performed (15*a*), the setting calculation unit 1*c* determines a strip thickness target value of each stand after the flying strip thickness change so as to allow the flying strip thickness change to be stably executed, based on the roll force distribution ratio actual value (or strip thickness actual value) of each stand before the flying strip thickness change. In addition, the setting calculation unit 1*c* predicts roll force after the flying strip thickness change and resets a new roll force distribution ratio target value.

[Math. 31]

$$\gamma_1^{AIM}:\gamma_2^{AIM}:\gamma_3^{AIM}:\ldots:\gamma_i^{AIM}:\ldots:\gamma_N^{AIM}:=P_1^{Pre_nxt}:P_2^{Pre_nxt}:P_3^{Pre_nxt}:\ldots:P_i^{Act}:\ldots:P_N^{Pre_nxt} \tag{31}$$

where $P_i^{Pre_nxt}$: a roll force prediction value after a thickness change of the i-th stand [kN]

$\gamma_i^{AIM}$: a roll force distribution ratio target value of the i-th stand [-]

The entry side strip thickness influence coefficient $Q_i$ is updated.

[Math. 32]

$$Q_i = \left(\frac{\partial P(T_{nxt}(i), H, h_{nxt}(i), V_{nxt}(i), \ldots)}{\partial H}\right)^{CAL} \tag{32}$$

where $T_{nxt}(i)$: entry side temperature of the i-th stand after the flying strip thickness change [degC]

$h_{nxt}(i)$: delivery side strip thickness of the i-th stand after the flying strip thickness change [mm]

$V_{nxt}(i)$: roll circumferential speed of the i-th stand after the flying strip thickness change [m/s]

The roll force distribution control device 10 stores a correction reference gap error before the execution of the flying strip thickness change. Since a roll gap is abruptly operated during the flying strip thickness change, the roll force distribution control is not executed before and after it. More specifically, before the flying strip thickness change is executed, calculation of the gap correction value and the target strip thickness correction value is interrupted. For example, the correction values are not changed from LE[m] before a roll gap of the most upstream stand is changed. Furthermore, the correction values are not changed until: the roll gap of each stand is changed; and the position of the material to be rolled 2*b* to which the change is applied advances LS[m] after passing through the strip thickness gauge 2*c* (15*b*).

The new roll force distribution ratio target value by equation (31) is updated before the roll force distribution control is resumed (15*c*).

In addition, since rolling conditions have changed after the flying strip thickness change, a difference between the strip thickness actual value and the strip thickness actual recalculation value abruptly changes in some cases. As a result of an abrupt change in the correction values according to the difference, if a roll gap is significantly changed, rolling may become unstable.

To prevent this abrupt change, the roll force distribution control device 10 calculates a correction reference gap error after the execution of the flying strip thickness change. More specifically, as shown in equation (35), the roll force distribution control device 10 calculates a correction reference gap error after the execution of the flying strip thickness change by adding a difference between a gap error after the flying strip thickness change and a gap error before the flying strip thickness change to a correction reference gap error before the flying strip thickness change. This updates the correction reference gap error. After the correction reference gap error is updated, the roll force distribution control is resumed and calculation of the gap correction value and the target strip thickness correction value is resumed.

[Math. 33]

$$S^{ofs_PREV}(i)=S^{ofs}(i) \tag{33}$$

[Math. 34]

$$S^{ERR_FGC}(i)=h^{GM_FGC}(i)-h^{MF_FGC}(i) \tag{34}$$

[Math. 35]

$$S^{OFS}(i)=S^{ofs_PREV}(i)+(S^{ERR_FGC}(i)-S^{ERR_PREV}(i)) \tag{35}$$

where $S^{ofs_PREV}(i)$: an offset value of the i-th stand before the flying strip thickness change [mm]

$h^{GM_FGC}(i)$: a strip thickness actual recalculation value of the i-th stand after the flying strip thickness change [mm] (calculated at the timing 15*d* by using equation (11))

$h^{MF_FGC}(i)$: a strip thickness actual value of the i-th stand after the flying strip thickness change [mm] (calculated at the timing 15*d* by using equation (12))

$S^{ERR_PREV}(i)$: a gap error of the i-th stand before the flying strip thickness change [mm] (calculated at the timing 15*e* by using equation (19))

As described above, according to the control of the present embodiment, when the strip thickness is changed by the flying strip thickness change and a new roll force distribution ratio target value is given, a roll force distribution ratio actual value can be matched with a new target roll force distribution ratio.

In the above example, the flying strip thickness change for one time has been described. However, even in a case where the flying strip thickness change is executed many times during rolling, control can be performed in a similar manner to the above example.

Fourth Embodiment

A roll force distribution control device according to a fourth embodiment changes a control gain which is used for calculating a correction value in the roll force distribution control, according to the type and size of the material to be rolled 2*b*.

The setting calculation unit 1*c* receives an input of type and size information of the material to be rolled 2*b* from the operating instruction input unit 1*b*. The setting calculation unit 1*c* determines the use or non-use of the roll force distribution control based on the type and size information.

Figure 16:
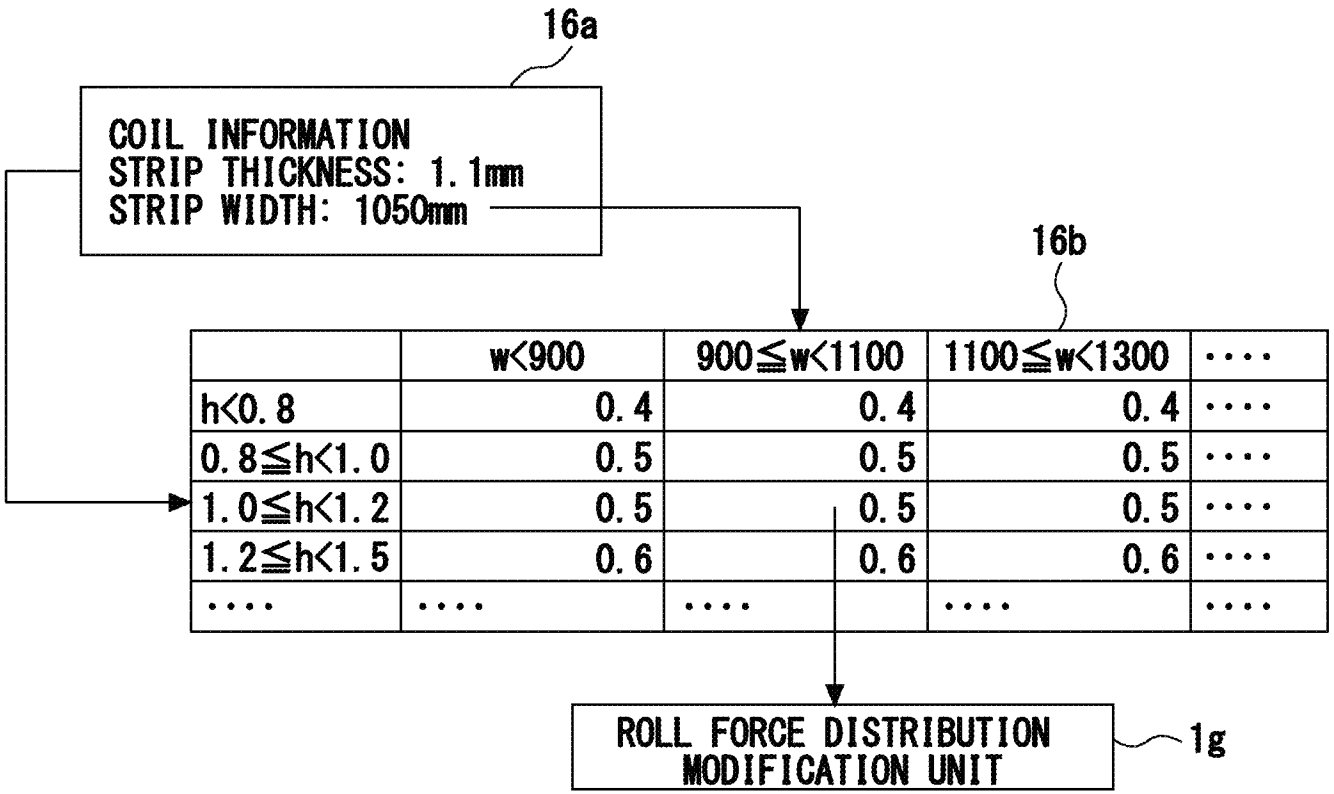
FIG. 16 is a diagram that shows a setting example of a table according to a fourth embodiment.

The setting calculation unit 1*c* stores in advance a table that defines a relationship between the type and size of the material to be rolled 2*b* and a control gain. FIG. 16 is a diagram that shows a setting example of the table. When the roll force distribution control is used, the setting calculation unit 1*c* obtains a parameter value corresponding to type and size information 16*a* from the table. The setting calculation unit 1*c* transmits this parameter value as a control gain to the roll force distribution modification unit 1*g*.

The roll force distribution modification unit 1*g* uses this control gain in calculation of the gap correction value and the target strip thickness correction value (equation (21), equation (27)).

According to the present embodiment, an optimum control gain according to the type and size information of the material to be rolled 2*b* can be applied to the calculation of the gap correction value and the target strip thickness correction value.

Fifth Embodiment

In order to stabilize a strip shape on a stand delivery side during rolling, each stand includes a shape control device (actuator) that controls the strip shape. For example, a bending device can control the strip shape by applying pressure to work roll ends to correct deformation of a roll. In addition, a work roll shift device can control the strip shape by shifting work rolls provided with an initial curve to change a width direction distribution of a roll gap.

Control of the strip shape is also possible by changing the deformation of the roll by changing the roll force of a stand. Therefore, in the present embodiment, when an output of the shape control device reaches its limit, roll force is changed by changing the roll force distribution ratio for the stand, thereby correcting the strip shape.

For example, the roll force distribution ratio for the i-th stand in which outputs of a bending device and a work roll shift device reach their limit values is modified. When a bending force is increased, pressure is applied in a direction of opening roll end portions and therefore, the amount of change in the strip thickness at the roll end portions is reduced. On the other hand, when roll force is reduced, roll deformation is reduced and therefore, the amount of change in the strip thickness at strip end portions is reduced. Therefore, when a roll bending force reaches the mechanical or operational maximum value during rolling, the roll force distribution ratio for the stand is reduced to determine a new roll force distribution ratio target value.

[Math. 36]

$$\gamma_1^{AIM}(\text{new}):\gamma_2^{AIM}(\text{new}):\gamma_3^{AIM}(\text{new}): \ldots : \gamma_i^{AIM}(\text{new}): \ldots \gamma_N^{AIM}(\text{new}):=\gamma_1^{AIM}:\gamma_2^{AIM}: \gamma_3^{AIM}:-\gamma: \ldots :\gamma_i^{AIM}: \ldots :\gamma_N^{AIM} \quad (36)$$

where $\Delta\gamma$: the amount of change in a roll force distribution ratio [-]

Thus, the roll force distribution control device 10 changes the roll force distribution ratio target value of a stand having a shape control device in a direction of reducing an output of the shape control device when the output reaches an upper limit value and in a direction of increasing an output of the shape control device when the output is reaches a lower limit value. According to this control, even when an output of the shape control device reaches a limit value, the strip shape can be improved by changing the roll force distribution ratio target value.

Sixth Embodiment

In the third embodiment, a gap error that occurs during FGC is integrated and stored to prevent an abrupt change. By transferring a gap error $S^{OFS}(i)$ to a gap correction value $\Delta S^{COMP}(i)$ in stages, a gap error that occurs during changing of strip thickness by flying strip thickness change can be reduced gradually with time.

[Math. 37]

$$\text{chgovr0}=\alpha(i)\cdot S^{OFS}(i) \quad (37)$$

[Math. 38]

$$\text{chgovr}=\text{Clamp}(\text{chgovr0},\Delta S^{COMP_UL}(i)-\Delta S^{COMP}(i), \Delta S^{COMP_LL}(i)-\Delta S^{COMP}(i)) \quad (38)$$

[Math. 39]

$$\Delta S^{COMP}(i)=\Delta S^{COMP}(i)+\text{chgovr} \quad (39)$$

[Math. 40]

$$S^{OFS}(i)=S^{OFS}(i)-\text{chgovr} \quad (40)$$

where $\alpha(i)$: a transfer gain (adjustment value, for example, 0.1) $(0\leq\beta\leq1.0)$ The roll force distribution control device 10 reduces a gap error $S^{OFS}(i)$ that occurs during FGC by using the above equation including the transfer gain $\alpha(i)$; and transfers a reduction amount to the gap correction value $\Delta S^{COPM}(i)$. As a result, a difference between a strip thickness actual value and a strip thickness actual recalculation value (gap error) can be reduced.

(Hardware Configuration Example)

Figure 17:
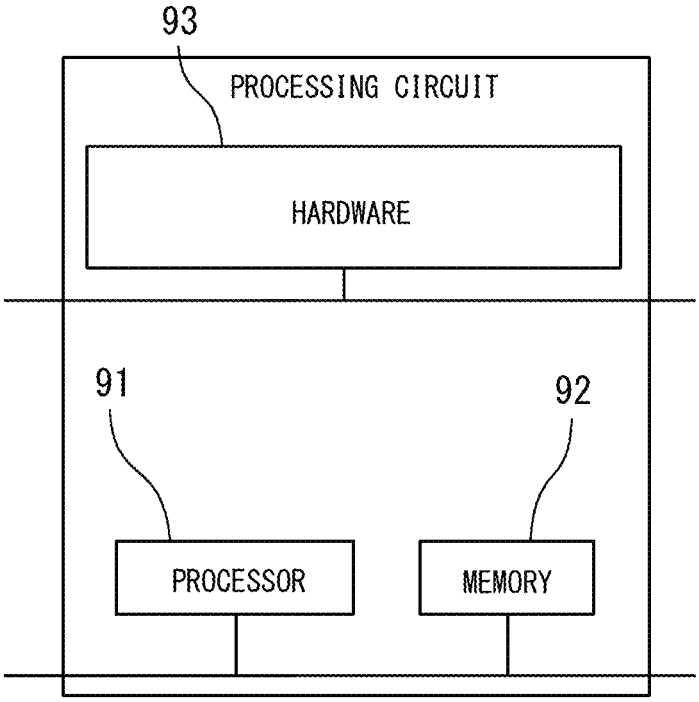
FIG. 17 is a conceptual diagram that shows a hardware configuration example of a processing circuit included in a roll force distribution control device 10 in each of the embodiments.

FIG. 17 is a conceptual diagram that shows a hardware configuration example of a processing circuit included in the roll force distribution control device 10 in each of the embodiments described above. Each of the above-mentioned functions is achieved by the processing circuit. In one aspect, the processing circuit includes at least one processor 91 and at least one memory 92. In another aspect, the processing circuit includes at least one piece of dedicated hardware 93.

In a case where the processing circuit includes the processor 91 and the memory 92, each of the functions is achieved by software, firmware, or a combination of the software and firmware. At least either the software or firmware is described as a program. At least either the software or firmware is stored in the memory 92. The processor 91 reads and executes a program stored in the memory 92, thereby implementing each of the functions.

In a case where the processing circuit includes the dedicated hardware 93, the processing circuit is, for example, a single circuit, a composite circuit, a programmed processor, or a combination of them. Each of the functions is provided by the processing circuit.

Although the embodiments according to the present disclosure have been described above, the present disclosure is not limited to the above embodiments and various modifications can be made without departing from the scope of the present disclosure. The configurations of the embodiments can be combined.

REFERENCE SIGNS LIST

1*b* Operating instruction input unit
1*c* Setting calculation unit
1*d* Gap operation unit
1*e* Actual data collection unit
1*f* Target strip thickness operation unit
1*g* Roll force distribution modification unit
1*h* Target strip thickness correction value calculation unit
1*i* Mass flow thickness correction unit
1*j* Tracking unit
2 tandem rolling mill
2*a* Rolling stand
2*b* Material to be rolled
2*c* Strip thickness gauge
3*a* Work roll
3*b* Backup roll
3*c* Hydraulic cylinder
3*d* Load cell
3*e* Encoder
4*a* Mill entry side temperature
4*b* Roll force actual value
4*c* Gap actual value
4*d* Delivery side strip thickness
5*a* Roll force actual value
5*b* Roll force distribution ratio target value
5*c* Roll force distribution ratio actual value
7*a* Strip thickness actual recalculation value
7*b* Strip thickness actual value
10 Roll force distribution control device
10*b* Gap correction value
10*c* Gap actual value
10*d* Roll force actual value
10*e* Strip thickness actual recalculation value
10*f* Strip thickness actual value
10*h* Target strip thickness correction value
11*a*, 11*b* Roll force actual value
12*a* Gap operation end intervention unit
16*a* Type and size information
20 Rolling line
91 Processor
92 Memory
93 Hardware

The invention claimed is:

1. A continuous rolling system that changes product specifications during continuous rolling of one strip of a material to be rolled, comprising:

a tandem rolling mill including a plurality of rolling stands, each of the plurality of rolling stands controlling a roll gap according to a roll gap operation value;

a strip thickness gauge provided on a delivery side of the tandem rolling mill, the strip thickness gage measuring strip thickness of the material to be rolled; and a roll force distribution control device matching an actual roll force ratio between the plurality of rolling stands with a target roll force ratio;

wherein the roll force distribution control device comprising:

a setting calculation unit determining:

a strip thickness target value of each of the plurality of rolling stands; and a roll force distribution ratio target value of each of the plurality of rolling stands, the roll force distribution ratio target value representing the target roll force ratio between the plurality of rolling stands;

an actual data collection unit collecting:

a roll force actual value of each of the plurality of rolling stands;

a roll gap actual value of each of the plurality of stands, the roll gap actual value being calculated based on the roll gap operation value of each of the plurality of rolling stands;

a roll rotational speed actual value of each of the plurality of rolling stands; and a strip thickness measurement value obtained by measurement with the strip thickness gauge;

a mass flow thickness correction unit performing:

calculating a strip thickness actual value of each of the plurality of rolling stands based on the strip thickness measurement value and the roll rotational speed actual value of each of the plurality of rolling stands;

calculating a strip thickness actual recalculation value of each of the plurality of rolling stands based on the roll force actual value of each of the plurality of rolling stands and the roll gap actual value of each of the plurality of rolling stands;

calculating a gap error of each of the plurality of rolling stands based on a difference between the strip thickness actual value of each of the plurality of rolling stands and the strip thickness actual recalculation value of each of the plurality of rolling stands; and calculating a gap correction value of each of the plurality of rolling stands, the gap correction value being for preventing the gap error of each of the plurality of rolling stands from being changed;

a target strip thickness correction value calculation unit performing:

calculating a roll force distribution ratio actual value of each of the plurality of rolling stands, the roll force distribution ratio actual value representing the actual roll force ratio between the plurality of rolling stands, based on the roll force actual value of each of the plurality of rolling stands; and calculating a target strip thickness correction value of each of the plurality of stands based on a difference between the roll force distribution ratio target value of each of the plurality of rolling stands and the roll force distribution ratio actual value of each of the plurality of rolling stands;

a tracking unit tracking a tracking point, the tracking point being set on the material to be rolled; and a gap operation unit outputting the roll gap operation value to a target rolling stand when the tracking point reaches each of the plurality of rolling stands, wherein the rolling stand to which the tracking point reaches is set as the target rolling stand, the roll gap operation value is calculated to bring a difference between a first value and a second value to zero, the first value being obtained by correcting the strip thickness target value of the target rolling stand with the target strip thickness correction value of the target rolling stand, and the second value being obtained by correcting the strip thickness actual recalculation value of the target rolling stand with the gap correction value of the target rolling stand.

2. The continuous rolling system according to claim 1, wherein the gap correction value is a correction value bringing to zero a difference between a correction reference gap error and a non-head-end gap error, the correction reference gap error being the gap error when a head end of the material to be rolled reaches the rolling stand, the non-head-end gap error being the gap error when a part other than the head end of the material to be rolled reaches the rolling stand.

3. The continuous rolling system according to claim 2, wherein the roll force distribution control device performs:

interrupting calculation of the gap correction value and the target strip thickness correction value before executing a flying strip thickness change, the flying strip thickness change causing the strip thickness target value of the tandem rolling mill to be changed without stopping rolling by the tandem rolling mill;

storing the correction reference gap error before execution of the flying strip thickness change;

resetting the roll force distribution ratio target value for the flying strip thickness change;

calculating the correction reference gap error after the execution of the flying strip thickness change, by adding a difference to the correction reference gap error before the execution of the flying strip thickness change, the difference being between the gap error after the execution of the flying strip thickness change and the gap error before the execution of the flying strip thickness change; and resuming the calculation of the gap correction value and the target strip thickness correction value after calculating the correction reference gap error after the execution of the flying strip thickness change.

4. The continuous rolling system according to claim 3, wherein the roll force distribution control device reduces the gap error gradually with time, the gap error occurring during changing of strip thickness by the flying strip thickness change.

5. The continuous rolling system according to claim 1, comprising:

a gap operation end intervention unit allowing the roll gap operation value to be changed based on an intervention signal by an operator;

wherein the roll force distribution control device performs:

calculating the roll force distribution ratio actual value of each of the plurality of rolling stands based on the roll force actual value of each of the plurality of rolling stands, the roll force actual value being collected after the roll gap operation value having been changed is applied to the tandem rolling mill; and updating the roll force distribution ratio target value of each of the plurality of rolling stands with the roll force distribution ratio actual value of each of the plurality of rolling stands.

6. The continuous rolling system according to claim 1, wherein the roll force distribution control device performs:

storing a table defining a relationship between a type and size of the material to be rolled and a control gain; and obtaining, from the table, the control gain corresponding to the type and size of the material to be rolled; and the gap correction value is calculated by multiplication by the control gain; and the target strip thickness correction value is calculated by multiplication by the control gain.

7. The continuous rolling system according to claim 1, wherein the rolling stand includes an actuator controlling a shape of the material to be rolled; and the roll force distribution control device performs change of the roll force distribution ratio target value of the rolling stand having the actuator, the change being performed in a direction of reducing an output of the actuator when the output reaches an upper limit value and in a direction of increasing an output of the actuator when the output reaches a lower limit value.

8. A continuous rolling system that changes product specifications during continuous rolling of one strip of a material to be rolled, comprising:

a tandem rolling mill including a plurality of rolling stands, each of the plurality of rolling stands controlling a roll gap according to a roll gap operation value;

a strip thickness gauge provided on a delivery side of the tandem rolling mill, the strip thickness gage measuring strip thickness of the material to be rolled; and a roll force distribution control device matching an actual roll force ratio between the plurality of rolling stands with a target roll force ratio;

wherein the roll force distribution control device comprising:

circuitry configured to determine a strip thickness target value of each of the plurality of rolling stands, and a roll force distribution ratio target value of each of the plurality of rolling stands, the roll force distribution ratio target value representing the target roll force ratio between the plurality of rolling stands, collect a roll force actual value of each of the plurality of rolling stands, a roll gap actual value of each of the plurality of stands, a roll rotational speed actual value of each of the plurality of rolling stands, and a strip thickness measurement value obtained by measurement with the strip thickness gauge, the roll gap actual value being calculated based on the roll gap operation value of each of the plurality of rolling stands, calculate a strip thickness actual value of each of the plurality of rolling stands based on the strip thickness measurement value and the roll rotational speed actual value of each of the plurality of rolling stands, calculate a strip thickness actual recalculation value of each of the plurality of rolling stands based on the roll force actual value of each of the plurality of rolling stands and the roll gap actual value of each of the plurality of rolling stands, calculate a gap error of each of the plurality of rolling stands based on a difference between the strip thickness actual value of each of the plurality of rolling stands and the strip thickness actual recalculation value of each of the plurality of rolling stands, calculate a gap correction value of each of the plurality of rolling stands, the gap correction value being for preventing the gap error of each of the plurality of rolling stands from being changed, calculate a roll force distribution ratio actual value of each of the plurality of rolling stands, the roll force distribution ratio actual value representing the actual roll force ratio between the plurality of rolling stands, based on the roll force actual value of each of the plurality of rolling stands, calculate a target strip thickness correction value of each of the plurality of stands based on a difference between the roll force distribution ratio target value of each of the plurality of rolling stands and the roll force distribution ratio actual value of each of the plurality of rolling stands, track a tracking point, the tracking point being set on the material to be rolled, and output the roll gap operation value to a target rolling stand when the tracking point reaches each of the plurality of rolling stands, wherein the rolling stand to which the tracking point reaches is set as the target rolling stand, the roll gap operation value is calculated to bring a difference between a first value and a second value to zero, the first value being obtained by correcting the strip thickness target value of the target rolling stand with the target strip thickness correction value of the target rolling stand, and the second value being obtained by correcting the strip thickness actual recalculation value of the target rolling stand with the gap correction value of the target rolling stand.

9. The continuous rolling system according to claim 8, wherein the gap correction value is a correction value bringing to zero a difference between a correction reference gap error and a non-head-end gap error, the correction reference gap error being the gap error when a head end of the material to be rolled reaches the rolling stand, the non-head-end gap error being the gap error when a part other than the head end of the material to be rolled reaches the rolling stand.

10. The continuous rolling system according to claim 9, wherein the circuitry is further configured to interrupt calculation of the gap correction value and the target strip thickness correction value before executing a flying strip thickness change, the flying strip thickness change causing the strip thickness target value of the tandem rolling mill to be changed without stopping rolling by the tandem rolling mill, store the correction reference gap error before execution of the flying strip thickness change, reset the roll force distribution ratio target value for the flying strip thickness change, calculate the correction reference gap error after the execution of the flying strip thickness change, by adding a difference to the correction reference gap error before the execution of the flying strip thickness change, the difference being between the gap error after the execution of the flying strip thickness change and the gap error before the execution of the flying strip thickness change, and resume the calculation of the gap correction value and the target strip thickness correction value after calculating the correction reference gap error after the execution of the flying strip thickness change.

11. The continuous rolling system according to claim 10, wherein the circuitry reduces the gap error gradually with time, the gap error occurring during changing of strip thickness by the flying strip thickness change.

12. The continuous rolling system according to claim 1, wherein the circuitry is further configured to allow the roll gap operation value to be changed based on an intervention signal by an operator, calculate the roll force distribution ratio actual value of each of the plurality of rolling stands based on the roll force actual value of each of the plurality of rolling stands, the roll force actual value being collected after the roll gap operation value having been changed is applied to the tandem rolling mill, and update the roll force distribution ratio target value of each of the plurality of rolling stands with the roll force distribution ratio actual value of each of the plurality of rolling stands.

13. The continuous rolling system according to claim 8, wherein the circuitry is further configured to store a table defining a relationship between a type and size of the material to be rolled and a control gain, and obtain, from the table, the control gain corresponding to the type and size of the material to be rolled, and the gap correction value is calculated by multiplication by the control gain; and the target strip thickness correction value is calculated by multiplication by the control gain.

14. The continuous rolling system according to claim 8, wherein the rolling stand includes an actuator controlling a shape of the material to be rolled; and the circuitry performs change of the roll force distribution ratio target value of the rolling stand having the actuator, the change being performed in a direction of reducing an output of the actuator when the output reaches an upper limit value and in a direction of increasing an output of the actuator when the output reaches a lower limit value.

15. A roll force distribution control device comprising:

circuitry configured to determine a strip thickness target value of each of a plurality of rolling stands of a tandem rolling mill, and a roll force distribution ratio target value of each of the plurality of rolling stands, each of the plurality of rolling stands controlling a roll gap according to a roll gap operation value, the roll force distribution ratio target value representing a target roll force ratio between the plurality of rolling stands, collect a roll force actual value of each of the plurality of rolling stands, a roll gap actual value of each of the plurality of stands, a roll rotational speed actual value of each of the plurality of rolling stands, and a strip thickness measurement value obtained by measurement with a strip thickness gauge, the strip thickness gauge being provided on a delivery side of the tandem rolling mill and measuring strip thickness of a material to be rolled, the roll gap actual value being calculated based on the roll gap operation value of each of the plurality of rolling stands, calculate a strip thickness actual value of each of the plurality of rolling stands based on the strip thickness measurement value and the roll rotational speed actual value of each of the plurality of rolling stands, calculate a strip thickness actual recalculation value of each of the plurality of rolling stands based on the roll force actual value of each of the plurality of rolling stands and the roll gap actual value of each of the plurality of rolling stands, calculate a gap error of each of the plurality of rolling stands based on a difference between the strip thickness actual value of each of the plurality of rolling stands and the strip thickness actual recalculation value of each of the plurality of rolling stands, calculate a gap correction value of each of the plurality of rolling stands, the gap correction value being for preventing the gap error of each of the plurality of rolling stands from being changed, calculate a roll force distribution ratio actual value of each of the plurality of rolling stands, the roll force distribution ratio actual value representing an actual roll force ratio between the plurality of rolling stands, based on the roll force actual value of each of the plurality of rolling stands, calculate a target strip thickness correction value of each of the plurality of stands based on a difference between the roll force distribution ratio target value of each of the plurality of rolling stands and the roll force distribution ratio actual value of each of the plurality of rolling stands, track a tracking point, the tracking point being set on the material to be rolled, and output the roll gap operation value to a target rolling stand when the tracking point reaches each of the plurality of rolling stands, wherein the rolling stand to which the tracking point reaches is set as the target rolling stand, the roll gap operation value is calculated to bring a difference between a first value and a second value to zero, the first value being obtained by correcting the strip thickness target value of the target rolling stand with the target strip thickness correction value of the target rolling stand, and the second value being obtained by correcting the strip thickness actual recalculation value of the target rolling stand with the gap correction value of the target rolling stand.

* * * * *